US005371529A

United States Patent [19]

Eguchi et al.

[11] Patent Number: 5,371,529

[45] Date of Patent: Dec. 6, 1994

[54] INK-JET PRINT HEAD AND INK-JET PRINTER

[75] Inventors: Yasuhito Eguchi, Kanagawa; Makoto Ando, Tokyo; Toshio Narushima; Kaoru Tomono, both of Kanagawa; Masayuki Sato, Tokyo; Masao Araya, Kanagawa, all of Japan

[73] Assignee: Sony Corporation, Japan

[21] Appl. No.: 961,982

[22] Filed: Oct. 16, 1992

[30] Foreign Application Priority Data

Oct. 17, 1991 [JP] Japan ..... 3-269452
Aug. 14, 1992 [JP] Japan ..... 4-238940

[51] Int. Cl.[5] ..... B41J 2/17

[52] U.S. Cl. ..... 347/7; 347/68; 347/95

[58] Field of Search ..... 346/140; 347/70, 68, 347/48, 98, 7, 95

[56] References Cited

U.S. PATENT DOCUMENTS

| | | | |
|---|---|---|---|
| 2,951,894 | 9/1960 | Hirsch | 346/140 X |
| 4,196,437 | 4/1980 | Hertz | 346/75 X |
| 4,435,721 | 3/1984 | Tsuzuki | 346/140 |
| 4,438,441 | 3/1984 | Bolmgren et al. | 346/140 R |
| 4,481,520 | 11/1984 | Esaki | 346/140 |
| 4,494,128 | 1/1985 | Vaught | 346/140 R |
| 4,525,727 | 6/1985 | Kohashi et al. | 346/140 R |
| 4,614,953 | 9/1986 | Lapeyre | 346/140 R |
| 4,987,429 | 1/1991 | Finley et al. | 346/157 |
| 4,992,808 | 2/1991 | Bartky et al. | 346/140 R |
| 5,053,787 | 10/1991 | Terasawa | 346/140 X |
| 5,113,198 | 5/1992 | Nishikawa et al. | 346/1.1 |

OTHER PUBLICATIONS

Patent Abstract of Japan vol. 8 No. 87 (M-291) (1524) 20 Apr. 1984 & JP-A-59 2 854 (Sanyo Denki) 9 Jan. 1984.

Patent Abstract of Japan vol. 7 No. 120 (M-217) (1265) 25 May 1983 & JP-A-58 38 189 (Tomoegawa Seisijiyo K.K.) 5 Mar. 1983.

*Primary Examiner*—Joseph W. Hartary
*Attorney, Agent, or Firm*—Ronald P. Kananen

[57] ABSTRACT

The present invention is to provide an on-demand type ink-jet printer which is free from the risk such that the nozzle is stopped and which is also free from the maintenance. An ink-jet print head comprises a liquid chamber (2) into which a carrier liquid (7) is filled, ink-jet driving means (3), (4) disposed within the liquid chamber (2), a nozzle (14) communicated with the liquid chamber (2) and a mixing unit (14*a*) disposed in the vicinity of the nozzle (14) for mixing an ink (9) into the carrier liquid (7). The ink (9) is mixed into the carrier liquid (7) in the liquid chamber (2) by the mixing unit (14*a*), pressed by the ink-jet driving means (3), (4) and then ink-jetted from the nozzle (14). Since the carrier liquid (7) is constantly filled into the nozzle (14), the nozzle (14) can be prevented from being choked up.

23 Claims, 26 Drawing Sheets

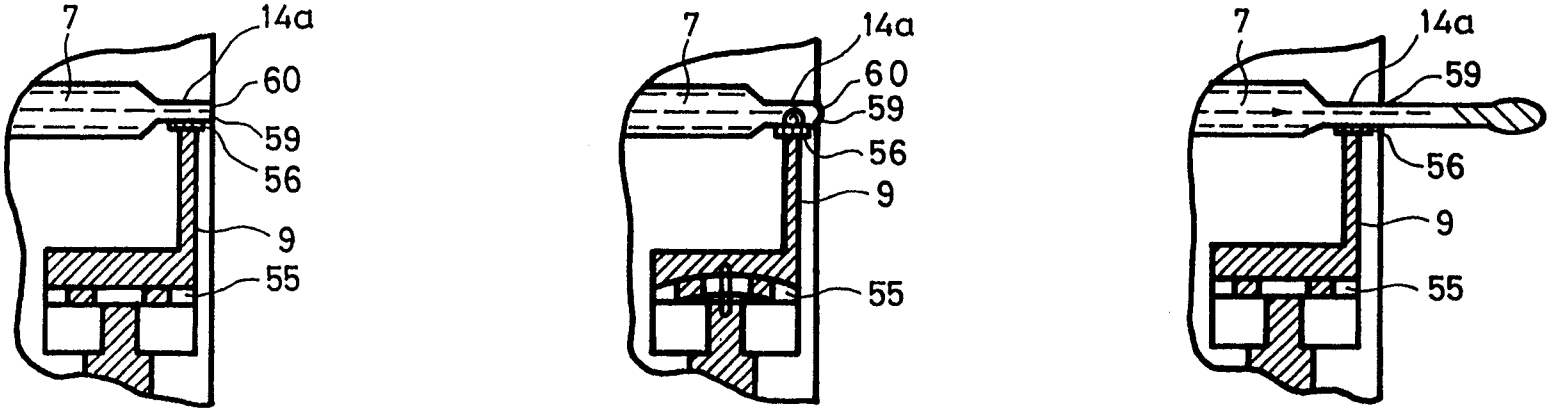
FIG. 11A
FIG. 11B
FIG. 11C
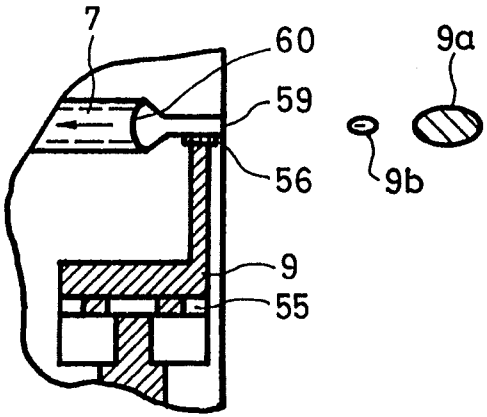
FIG. 11D
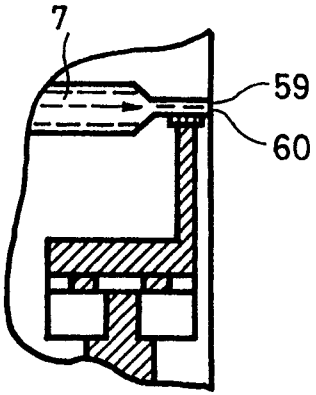
FIG. 11E

INK-JET PRINT HEAD AND INK-JET PRINTER

BACKGROUND OF THE INVENTION

1. Field of the Invention

The present invention relates to ink-jet printers and, more particularly, is directed to an ink-jet printer of a drop-on-demand type.

2. Description of the Related Art

Conventional ink-jet printers are roughly classified into a continuous droplet type and a drop-on-demand type. Drop-on-demand type ink-jet printers are classified into an electromechanical transducer type, an electrothermal conversion type, an electrostatic adsorption type and a discharge type.

According to the continuous droplet type ink-jet printers, ink drops are exhausted from a very small nozzle, so that the thus exhausted ink drops are exhausted at a constant cycle by vibration and the ink drops are electrified with charges so that the ink drops are deflected or diffused. Although the continuous droplet type ink-jet printer becomes large in size and the ink used must be collected, the continuous droplet type ink-jet printer has a high frequency responsiveness so that it is suitable for high speed recording. Moreover, if the inner diameter of the nozzle is reduced or ink drops are divided into smaller ink droplets, then an image of high resolution can be produced.

As compared with the continuous droplet type ink-jet printer, the drop-on-demand type ink-jet printer can be simplified in structure, made compact in size, and is inexpensive as compared with the continuous droplet type one. Therefore, the drop-on-demand type ink-jet printers are widely used.

According to a print head of the drop-on-demand type ink-jet printers, the ink is jetted by a pressure caused when a piezoelectric element is deformed or by a pressure of bubbles caused when the ink is heated and boiled by a heating element.

Since the drop-on-demand type ink-jet printer is not arranged so as to constantly exhaust the ink from its nozzle unlike the continuous droplet-type ink-jet printer, it is frequently observed that the nozzle is clogged or choked-up with dried ink, denatured ink, ink dusts or the like. Hence, the ink cannot be exhausted smoothly, which unavoidably requires maintenance. Furthermore, since it is difficult for the drop-on-demand type ink-jet printer to produce a middle tone printing, it is unavoidable that this type of ink-jet printer produces the middle tone printing by utilizing a so-called dither processing in a quasi-printing fashion. Therefore, the quality of printing image is not sufficient and an image cannot be printed in full color in a full color simultaneous printing fashion. Furthermore, in this drop-on-demand type ink-jet printer, a drive mechanism thereof becomes large in size. Moreover, there is a significant restriction for modifying a nozzle in the form of a multi-nozzle. As a result, it is impossible to realize high speed printing by modifying a print head as a line-head.

OBJECTS AND SUMMARY OF THE INVENTION

Therefore, it is an object of the present invention to provide an improved ink-jet print head and an improved ink-jet printer of the drop-on-demand type in which the aforesaid shortcomings and disadvantages encountered with the prior art can be eliminated.

More specifically, it is an object of the present invention to provide an ink-jet print head and an ink-jet printer of the drop-on-demand type in which a nozzle is free from the risk that it is clogged or choked-up and in which maintenance becomes substantially unnecessary.

It is another object of the present invention to provide an ink-jet print head and an ink-jet printer of the drop-on-demand type in which a middle tone printing of high quality can be provided.

It is still another object of the present invention to provide an ink-jet print head and an ink-jet printer of the drop-on-demand type in which an image can be printed simultaneously in full color.

It is a further object of the present invention to provide an ink-jet print head and an ink-jet printer in which a nozzle can be modified as multi-nozzles with ease so that high speed printing can be realized with ease by a line-head.

It is yet a further object of the present invention to provide an ink-jet print head and an ink-jet printer in which an ink and a transparent solvent serving as a carrier liquid can be prevented from being naturally mixed with each other between an ink estimating unit and an ink mixing unit.

As a first aspect of the present invention, an ink-jet print head is provided which comprises a liquid chamber into which a carrier liquid is filled, ink-jet driving means disposed within said liquid chamber, a nozzle communicated with the liquid chamber, and a mixing unit disposed in the vicinity of the nozzle for mixing an ink with the carrier liquid.

According to a second aspect of the present invention, the ink-jet print head further comprises adjusting means for adjusting an amount of the ink which is mixed into the carrier liquid in the mixing unit.

According to a third aspect of the present invention, the adjusting means comprises electroosmosis units serving as a plurality of adjusting units which respectively adjust mixing amounts of inks of a plurality of colors.

According to a fourth aspect of the present invention, a plurality of nozzles are communicated with the liquid chamber.

According to a fifth aspect of the present invention, the adjusting means for adjusting the mixing amount of the ink is an electroosmosis ink constant amount unit having a first porous membrane disposed within an ink tank which is filled with the ink.

According to a sixth aspect of the present invention, the ink-jet print head further comprises a first one-way valve that presents a back current of the ink disposed in an ink supply path which communicates the ink tank and the mixing unit.

According to a seventh aspect of the present invention, the ink-jet print head further comprises a second porous membrane disposed on a connection portion between the ink supplying path and the mixing unit.

According to an eighth aspect of the present invention, the ink-jet print head further comprises a second one-way valve provided between the liquid chamber and the mixing unit.

According to a ninth aspect of the present invention, the ink-jet print head further comprises a third one-way valve disposed at the entrance of the liquid chamber.

According to a tenth aspect of the present invention, the driving means disposed in the liquid chamber is a bimorph piezoelectric element.

According to an eleventh aspect of the present invention, the bimorph piezoelectric element is in contact with the carrier liquid within the liquid chamber.

According to a twelfth aspect of the present invention, the driving means disposed in the liquid chamber is a monomorph piezoelectric element.

According to a thirteenth aspect of the present invention, the ink-jet print head further comprises an opening and closing mechanism for adjusting a mixing amount of the ink disposed at an ink supplying orifice of the mixing unit.

According to a fourteenth aspect of the present invention, the opening and closing mechanism comprises a valve seat and a piezoelectric element in which a spacing between the element and the valve seat is changed by the application of a voltage to the piezoelectric element.

According to a fifteenth aspect of the present invention, the opening and closing mechanism is a part of the driving means disposed in the liquid chamber and which is composed of the piezoelectric element.

According to a sixteenth aspect of the present invention, a spacing between the valve seat and the piezoelectric element is opened and closed in a vibrating fashion.

According to a seventeenth aspect of the present invention, a spacing between the valve seat and the piezoelectric element is opened and closed by the piezoelectric element in the ink-jet driving means.

According to an eighteenth aspect of the present invention, the ink-jet print head comprises a plurality of mixing units, each having an opening and closing mechanism.

According to a nineteenth aspect of the present invention, inks of different colors are mixed in a time division manner by the plurality of mixing units.

According to a twentieth aspect of the present invention, the plurality of mixing units mix inks of a plurality of colors by the changes of resonance frequencies of the piezoelectric elements are provided in a plurality of mixing units, respectively.

According to a twenty-first aspect of the present invention, an ink-jet printer is provided which comprises a rotary drum around which a material to be printed is wrapped, a print head disposed movable in the axial direction of the rotary drum, and a driving means for moving the print head in an axial direction of the rotary drum in a ganged relation with a rotation of the rotary drum, the print head being the ink-jet print head defined in any one of the first to twentieth aspects of the invention.

According to a twenty-second aspect of the present invention, the ink-jet printer further comprises a driving member for rotating the rotary drum in a ganged relation to the movement of the print head.

According to a twenty-third aspect of the present invention, the print head includes a plurality of heads arrayed in the axial direction of the rotary drum, the plurality of heads being the ink-jet heads defined in any of the first to twentieth aspects of the invention.

In accordance with the ink-jet print head of the first aspect of the invention, the ink is mixed into the transparent solvent in the liquid chamber by the mixing unit and the mixing units are driven by the piezoelectric elements to exhaust the mixed ink from the nozzle. Therefore, since the transparent solvent is constantly filled into the nozzle, the nozzle can be prevented from being clogged or choked-up.

In accordance with the ink-jet print head of the second aspect of the present invention, the amount in which the ink is mixed into the transparent solvent is adjusted by the electroosmosis units thereby to make it possible to carry out a middle tone printing.

In accordance with the ink-jet print head of the third aspect of the present invention, the mixing amounts of the inks of the plurality of colors are respectively adjusted by the plurality of electroosmosis units thereby to make it possible to simultaneously print an image in full color.

In accordance with the ink-jet print head of the fourth aspect of the present invention, a plurality of nozzles are communicated with the liquid chamber so that high speed printing can occur with ease by the line head.

In accordance with the ink-jet print head of the fifth aspect of the present invention, the electroosmosis unit having the first porous membrane is disposed within the ink tank so that the ink of a predetermined amount can be supplied to the mixing unit.

In accordance with the ink-jet print head of the sixth aspect of the present invention, since the first one-way valve is provided in the ink supplying path, a back current of the ink can be avoided.

In accordance with the ink-jet print head of the seventh aspect of the present invention, since the second porous membrane is disposed between the ink supplying path and the mixing unit, the ink and the transparent solvent can be prevented from being uselessly mixed with each other.

In accordance with the ink-jet print head of the eighth aspect of the present invention, since the second one-way valve is disposed between the liquid chamber and the mixing unit, the transparent solvent into which the ink is mixed can be prevented from flowing into the liquid chamber.

In accordance with the ink-jet print head of the ninth aspect of the present invention, since the third one-way valve is disposed at the entrance of the liquid chamber, a pressure transmitted to the liquid chamber by the piezoelectric element can be blocked so that the mixed liquid can be exhausted efficiently.

In accordance with the ink-jet print heads of the tenth to twelfth aspects of the present invention, the kinds and locations of the piezoelectric elements are illustrated.

In accordance with the ink-jet print heads of the thirteenth to seventeenth aspects of the present invention, since the opening and closing mechanism is disposed at the ink supplying orifice of the mixing unit, the ink and the transparent solvent can be prevented from being mixed with each other naturally.

In accordance with the ink-jet print heads of the eighteenth to twentieth aspects of the present invention, since there are provided a plurality of mixing units each of which includes an opening and closing mechanism, a clear color printing can be made by a single noise without mixing many colors.

In accordance with the ink-jet print head of the twenty-first to twenty-third aspects of the present invention, the transport and location of the head relative to the rotating drum around which the printing paper is wrapped can be varied significantly, such as by a factor of three times.

BRIEF DESCRIPTION OF THE DRAWINGS

A better understanding of other objects, features, and advantages of the present invention can be gained from a consideration of the following detailed description of illustrative embodiments thereof, in conjunction with the figures of the accompanying drawings, wherein:

FIGS. 11A through 11E are respectively fragmentary, enlarged cross-sectional views of FIGS. 10A to 10E;

DETAILED DESCRIPTION OF THE PREFERRED EMBODIMENTS

The present invention will now be described in detail with reference to the accompanying drawings.

Figure 1:
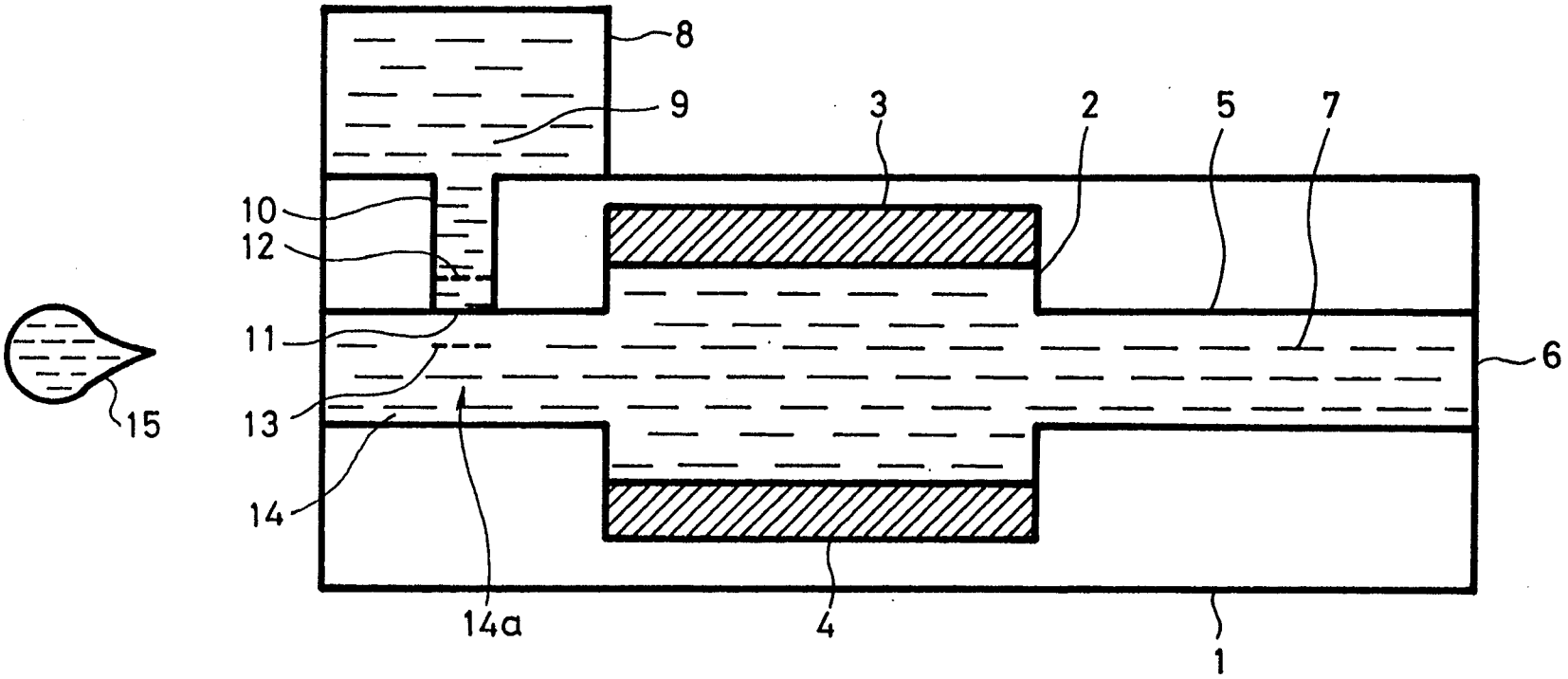
FIG. 1 is a longitudinal cross-sectional view showing a structure of an ink-jet printer head according to a first embodiment of the present invention.
Figure 2:
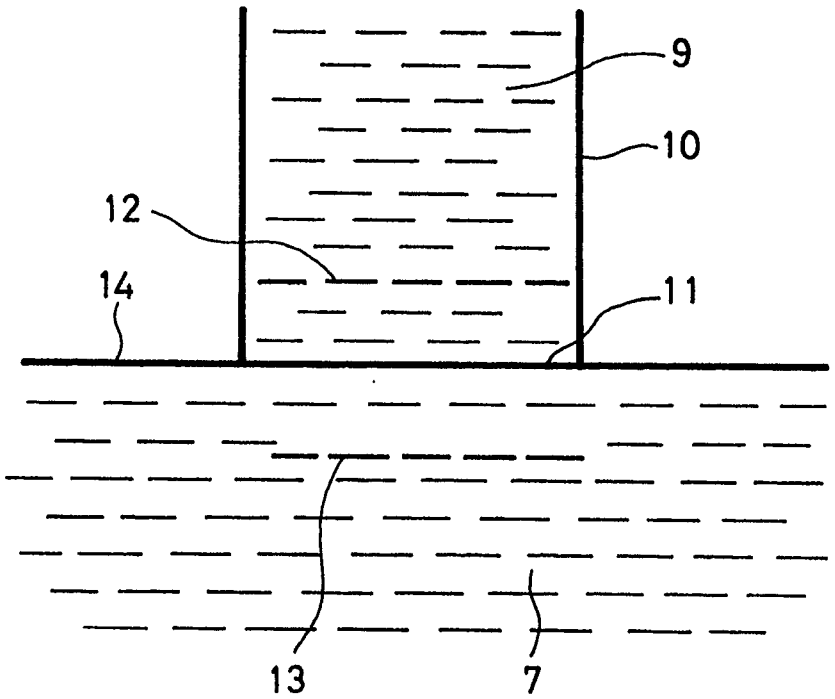
FIG. 2 is an enlarged cross-sectional view showing a nozzle portion of the ink-jet printer head shown in FIG. 1.

An ink-jet printer according to a first embodiment of the present invention will now be described with reference to FIGS. 1 to 3 of the accompanying drawings.

As illustrated, the ink-jet printer according to this embodiment includes a housing 1 in which there are disposed respective elements and parts that will be described hereafter in this description of the invention. That is, the housing 1 includes a liquid chamber 2 in which a carrier liquid 7 is filled. A pipe 5 is communicated with the liquid chamber 2 and is coupled to a carrier liquid supply pipe 17 that is shown in FIG. 3. The pipe 5 includes an orifice 6. The carrier liquid 7 might be transparent water, alcohol and other organic solvents. The liquid chamber 2 includes ink-jet drivers 3 and 4. The ink-jet drivers 3, 4 are each composed of a piezoelectric element. When applied with a pulse-like voltage, the ink-jet drivers 3, 4 are deformed toward the inside of the liquid chamber 2 thereby to press the carrier liquid 7 within the liquid chamber 2 momentarily.

The ink-jet drivers 3, 4 or electromechanical transducer type ink-jet drivers may be replaced with conventional electrothermal conversion type, electrostatic adsorption type, discharge-type ink-jet drivers, and so forth.

A fine nozzle 14 is communicated with the liquid chamber 2. A concentrated ink 9 within an ink tank 8 is introduced through a pipe 10 into the nozzle 14. As shown also in FIG. 2 of the accompanying drawings, a diaphragm 11 having a sluice valve function is bonded to the outlet orifice of the pipe 10. The diaphragm 11 might be a mesh-like membrane, a porous membrane, a semipermeable membrane or the like. Since the diaphragm 11 is bonded to the orifice of the pipe 10, the concentrated ink 9 within the ink tank 8 can be prevented from being naturally mixed into the carrier liquid 7 within the nozzle 14.

Mesh electrodes 12, 13 are respectively disposed on both sides of the diaphragm 11. When a DC voltage is applied across the mesh electrodes 12 and 13, owing to electroosmosis or electrophoresis, the concentrated ink 9 within the ink tank 8 passes through the diaphragm 11 and permeates into the nozzle 14, thereby being mixed with the carrier liquid 7. An amount of the ink 9 permeated into the nozzle 14 is proportional to a current flowing between the mesh electrodes 12, 13. Therefore, by controlling the amount of current, the amount of the concentrated ink 9 permeated into the nozzle 14 can be controlled with high accuracy. This amount of the permeated ink 9 is determined on the basis of physical characteristics of the carrier liquid 7, a spacing between the mesh electrodes 12 and 13, the areas of the mesh electrodes 12, 13, the voltage applied across the mesh electrodes 12, 13, a time period in which the voltage is applied across the mesh electrodes 12, 13, and so forth.

The concentrated ink 9 might be moved toward the carrier liquid 7 side within the nozzle 14 by some conventional means such as electrical, electrochemical, mechanical means and so on.

The carrier liquid 7 and the concentrated ink 9 might be made of materials that can be easily mixed with each other (i.e., water-base liquid/water-base ink) or materials that are difficult to be mixed with each other (i.e. water-base liquid/oil-base ink). In the latter case, the voltage applied across the ink-jet drivers 3, 4 is converted into a high frequency voltage and both of the carrier liquid 7 and the concentrated ink 9 can be forcibly mixed with each other according to the ultrasonic process.

Figure 3:
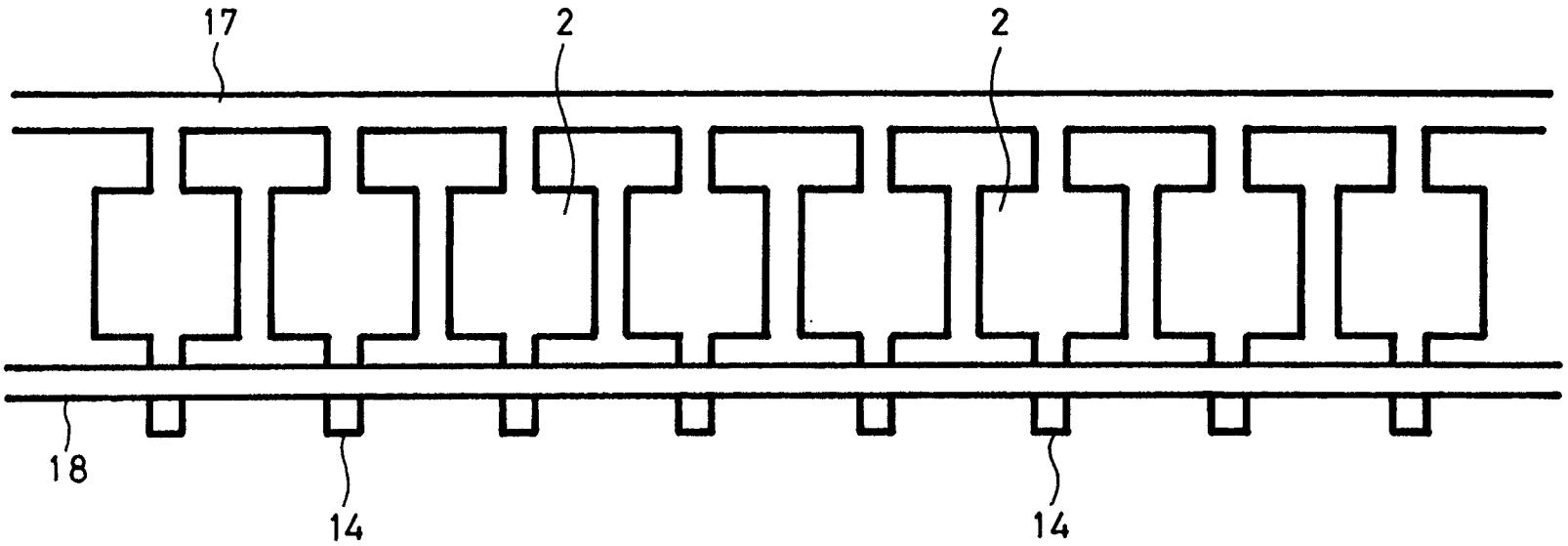
FIG. 3 is an explanatory diagram showing an overall arrangement of the first embodiment shown in FIG. 1.

As shown in FIG. 3 of the accompanying drawings, a plurality of liquid chambers 2 are provided, each of which includes the ink-jet drivers 3, 4 (not specifically shown in FIG. 3) and the nozzle 14. The carrier liquid 7 is supplied through a carrier liquid supply pipe 17 to the respective liquid chambers 2. The concentrated ink 9 is supplied from an ink supply pipe 18 to the respective ink tanks 8 (also not shown in FIG. 3) that are provided in association with the respective liquid chambers 2. A plurality of nozzles 14 are arrayed on a straight line with an equal interval between respective pairs of nozzles.

Operation of the first embodiment will be described below.

A certain voltage is applied across the mesh electrodes 12, 13 disposed between a predetermined ink tank 8 and nozzle 14 during a certain period of time, whereby a predetermined amount of the concentrated ink 9 within the ink tank 8 is permeated through the diaphragm 11 and then mixed into the carrier liquid 7 within the nozzle 14. Thereafter, a predetermined voltage is applied across the ink-jet drivers 3, 4 of the desired liquid chamber 2, whereby ink particles 15 or only carrier liquid particles, which do not contain the ink, are jetted from the nozzle 14. These jetted ink particles 15 stick to a paper (not shown) to print characters, graphic patterns, images or the like on the paper. The capacity of the inside of the nozzle 14 is selected to be equivalent to a volume of one ink particle 15 or liquid particle containing no ink. Therefore, no interference concerning the ink density substantially takes place between the jetted particle and the particle to be jetted next. If the voltage applied across the mesh electrodes 12, 13 and the time period during which the voltage is applied across the mesh electrodes 12, 13 are controlled, then the amount of the concentrated ink 9 mixed into the carrier liquid 7 is controlled, thereby making it possible to effect a middle tone printing at an arbitrary density. Accordingly, if the printing is made in the lightest color, then the mixing amount of the ink 9 is zero and transparent particles formed of only the carrier liquid 7 are stuck to the paper.

Figure 4:
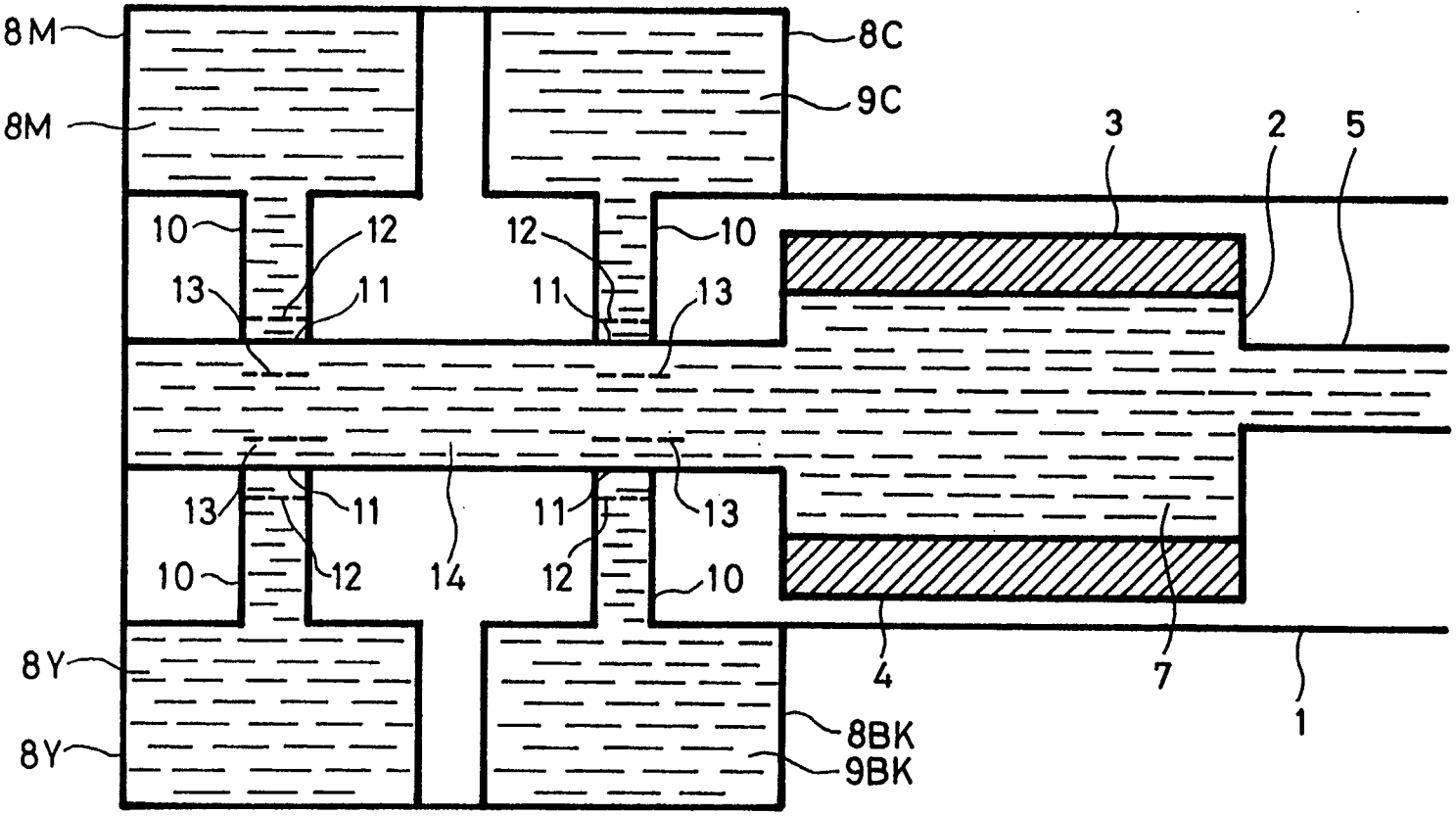
FIG. 4 Is a longitudinal cross-sectional view showing an arrangement of the ink-jet printer according to a second embodiment of the present invention.

The ink-jet printer according to a second embodiment of the present invention will hereinafter be described with reference to FIG. 4. In FIG. 4 of the accompanying drawings, like parts corresponding to those of FIGS. 1 and 2 are marked with the same reference numerals and therefore need not be described in detail.

According to the second embodiment of the present invention, as shown in FIG. 4, the housing 1 accommodates therein ink tanks 8M, 8Y, 8C and 8BK which contain therein a magenta ink 9M, a yellow ink 9Y, a cyan ink 9C and a black ink 9BK, respectively. The pipes 10 of the respective ink tanks 8M, 8Y, 8C and 8BK are respectively coupled to the nozzles 14. Owing to the respective diaphragms 11 and the respective mesh electrodes 12 and 13 of the respective ink tanks 8M, 8Y, 8V and 8BK, the color inks 9M, 9Y, 9C and 9BK, each of which is in a desired amount, are mixed into the carrier liquids 7 within the nozzles 14 and ink particles 15 (not shown in FIG. 4) of arbitrary colors can be jetted to stick to the paper (not shown), thereby effecting the simultaneous multi-color printing. In this case, if the under-color removal is implemented by utilizing the black ink 9BK, then the entire mixing amount of the inks can be reduced as compared with the case such that only the color inks 9M, 9Y and 9C are mixed. The reason for this is that, if a portion corresponding to the black, which results from mixing the inks of respective colors, is replaced with the black ink, then the amount of the ink corresponding to the India ink portion can be reduced three times to twice.

Figure 5:
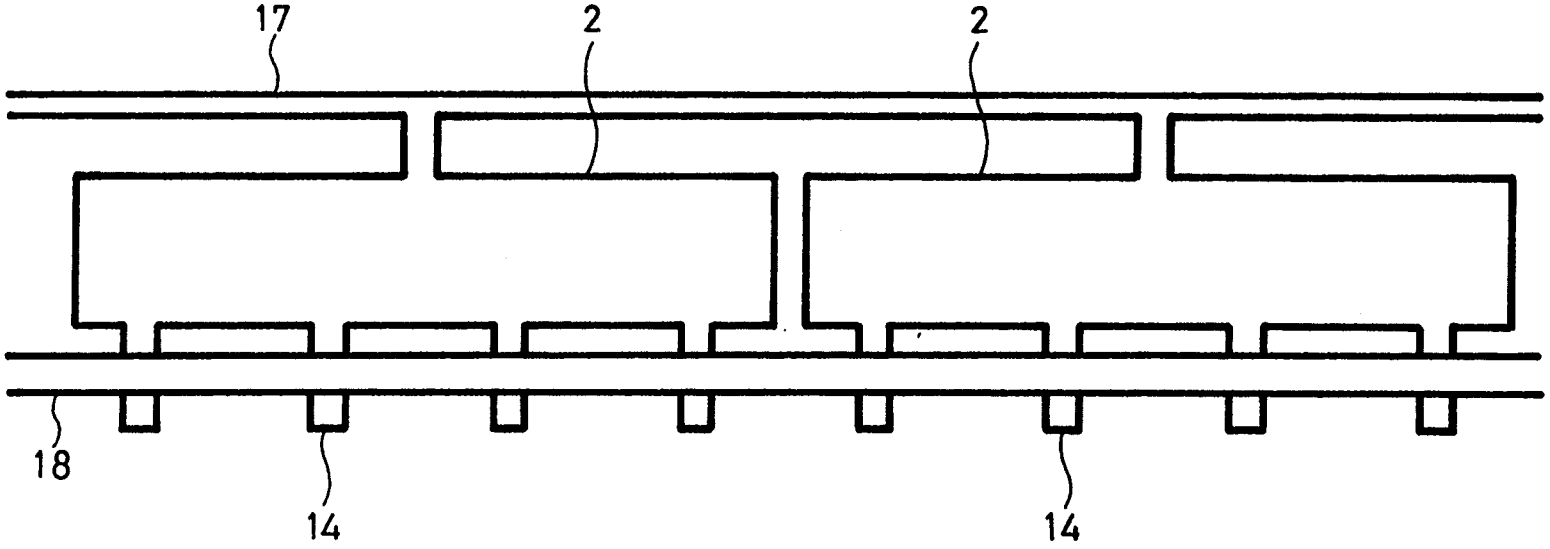
FIG. 5 is an explanatory diagram showing an overall arrangement of a third embodiment according to the present invention.

While the single nozzle 14 is provided in each liquid chamber 2 which includes the ink-jet drivers 3, 4 according to the first embodiment of the present invention as shown in FIG. 3, the present invention is not limited thereto and each liquid chamber 2 may include a plurality of nozzles 14 as shown in FIG. 5. A predetermined amount of the concentrated ink 9 is mixed into the carrier liquid 7 at every nozzle 14 and the ink particles 15 or the carrier liquid particles containing no ink are jetted from the respective nozzles 14 by the ink-jet drivers 3, 4 (not shown in FIG. 5) of the liquid chamber 2 at the same time, to thereby stick the ink particles 15 or the carrier liquid particles to the paper (not shown).

FIGS. 6 through 9 of the accompanying drawings show examples of the structures of the ink-jet printers on which an example of an ink-jet printer head 21 according to the present invention is mounted.

Figure 6:
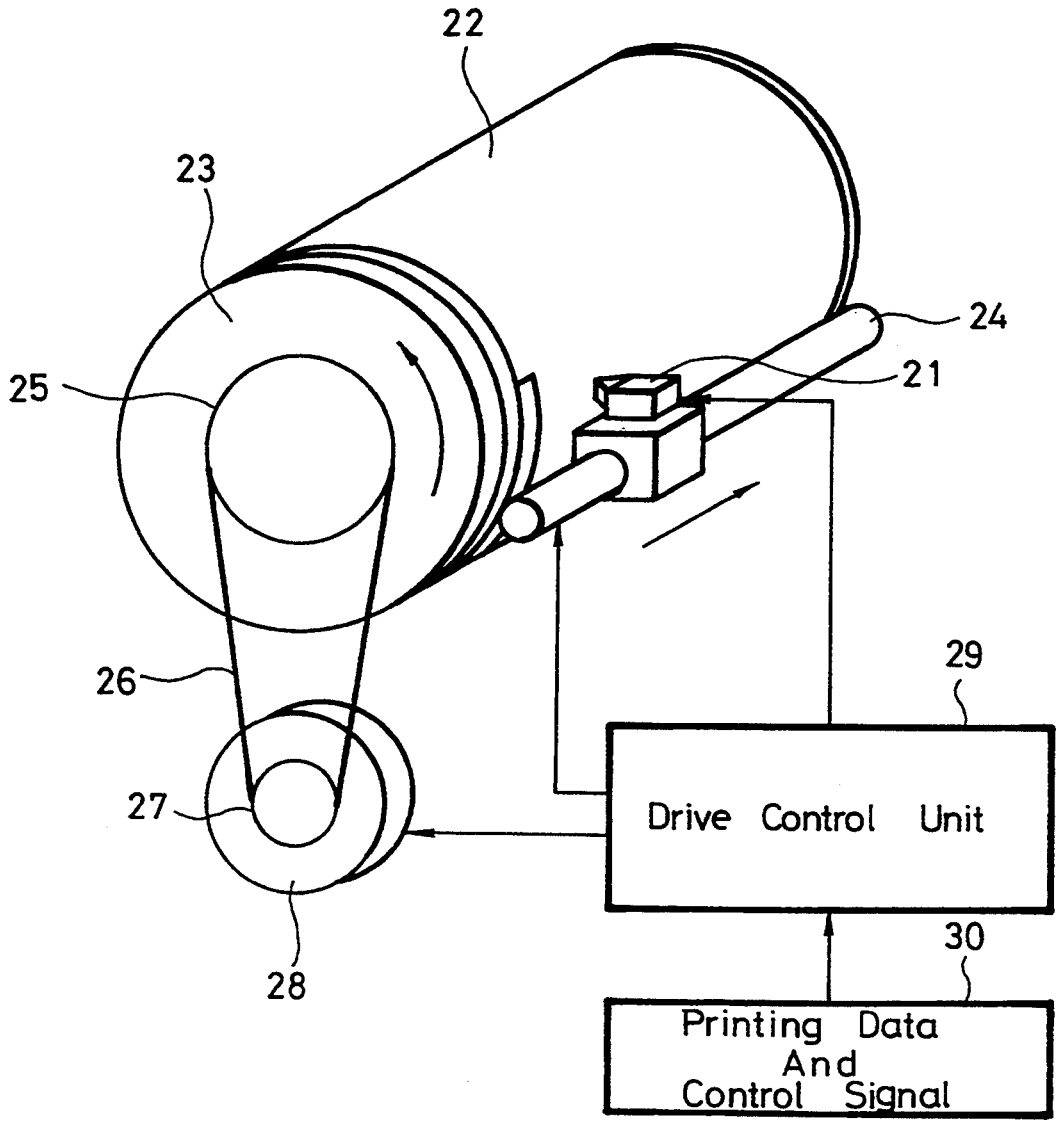
FIG. 6 is a perspective view showing a structure of an example of a drum rotation type ink-jet printer according to the present invention.

FIG. 6 shows an example of a structure of the ink-jet printer head of a drum rotation type. As shown in FIG. 6, a printing paper 22 that is prepared as a material to be printed is wrapped around the outer circumference of a rotary drum 23 and fixed at a predetermined position. A feed screw 24 is disposed in the outer circumference of the drum 23 in parallel to the drum shaft direction. The ink-jet printer head 21 is fitted into the feed screw 24 by screws (not shown). By the rotation of the feed screw 24, the head 21 is moved in the axial direction or the rotary drum 23. The rotary drum 23 is rotated through a pulley 25, a belt 26 and a pulley 27 by means of a motor 28. The rotation of the feed screw 24 and the motor 28 and the movement of the head 21 are controlled by a drive control unit 29 on the basis of a printing data and control signal 30.

When the rotary drum 23 is rotated, the head 21 jets an ink in synchronism with the rotation of the drum 23 to form an image on the printing paper 22. When the drum 23 is rotated once to complete the printing of one column on the printing paper 22 along the peripheral direction thereof, the feed screw 24 is rotated to move the head 21 one pitch to thereby print the next column. Alternatively, the drum 23 and the feed screw 24 are simultaneously rotated so that the head 21 is progressively moved while the printing is being made. If the head 21 is a multi-nozzle head or if the head 21 prints the same portion repeatedly, then the head 21 is suitably moved step by step. If the head 21 is of a single nozzle type or if the head 21 is of a multi-nozzle type having less nozzles, then the head 21 carries out the printing in a spiral fashion while the drum 23 and the feed screw 24 are simultaneously rotated in a ganged relation.

Figure 7:
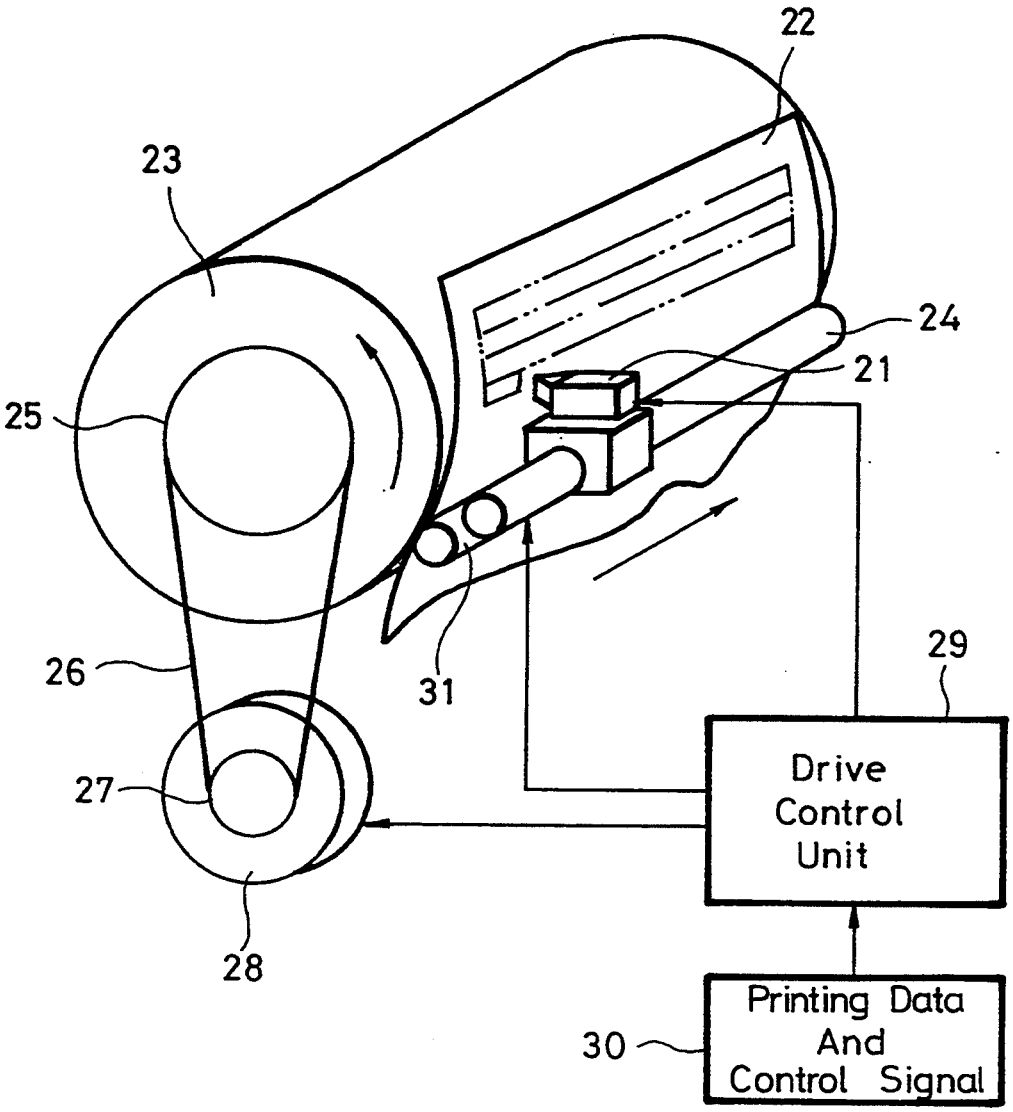
FIG. 7 is a perspective view showing a structure of an example of a serial type ink-jet printer according to the present invention.

FIG. 7 of the accompanying drawings shows an example of the ink-jet printer that is arranged as a serial type. Although this serial type printer has a structure substantially similar to that of the drum rotation type printer shown in FIG. 6, the printing paper 22 is not wrapped around the drum 23 but urged against the rotary drum 23 by means of a paper pressing roller 31 that is disposed in substantially parallel to the axial direction of the rotary drum 23. In this case, when the head 21 is moved to print one row, the rotary drum 23 is rotated by the amount of one row to print the next row. The head 21 is moved either in the same direction or in a reciprocating direction.

Figure 8:
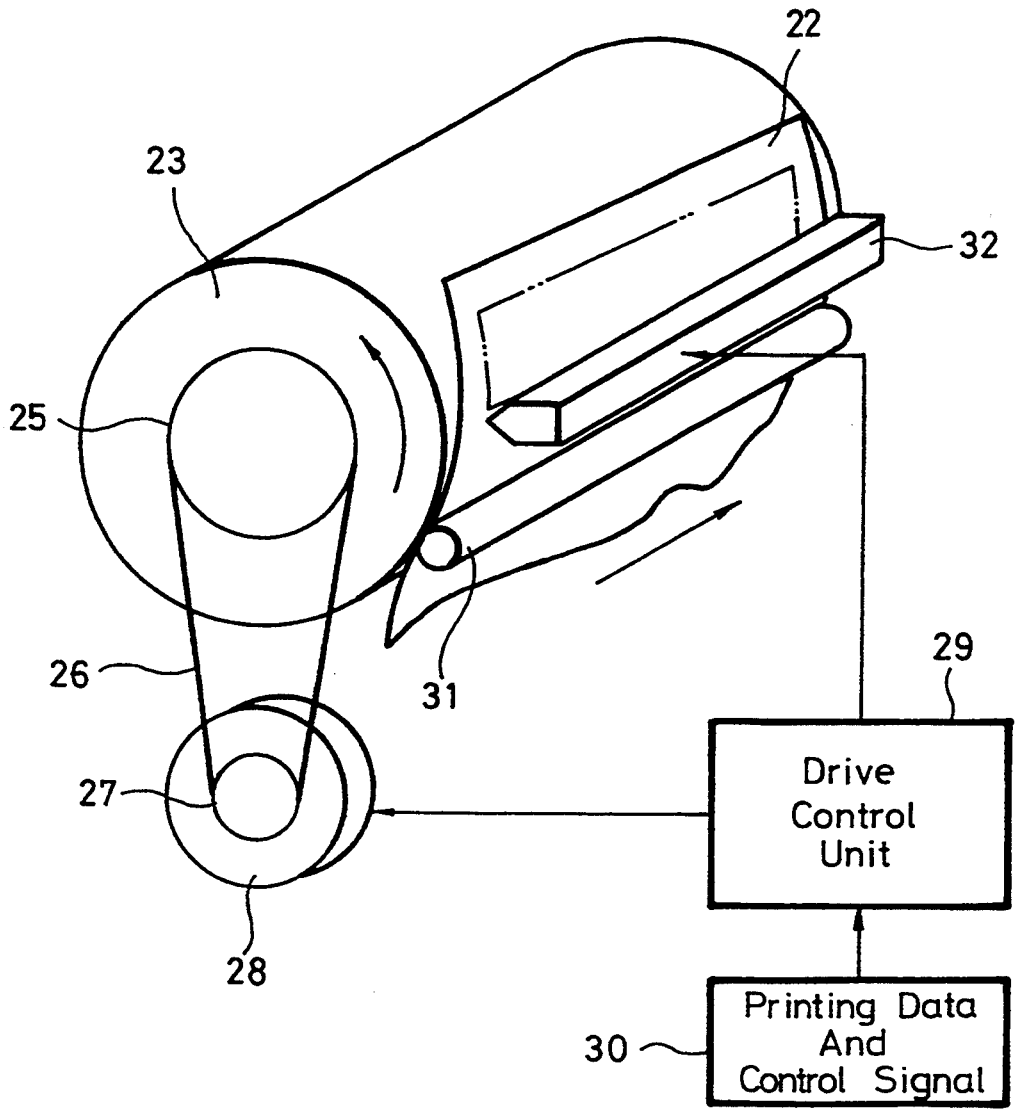
FIG. 8 is a perspective view showing a structure of an example of a line-type ink-jet printer according to the present invention.

FIG. 8 of the accompanying drawings shows an example of the ink-jet printer that is arranged as a line type. As shown in FIG. 8, instead of the serial type head 21 and the feed screw 24 shown in FIG. 7, a line head 32 formed of an array of a number of heads 21 is fixed to the axial direction of the rotary drum 23. According to the above-mentioned arrangement of the printer, the printing of one row is carried out at the same time by the line head 32. At the completion of the printing, the drum 23 is rotated by the amount of one row to print the next row. Alternatively, all lines may be printed simultaneously, a plurality of divided blocks are printed or every other rows are printed.

Figure 9:
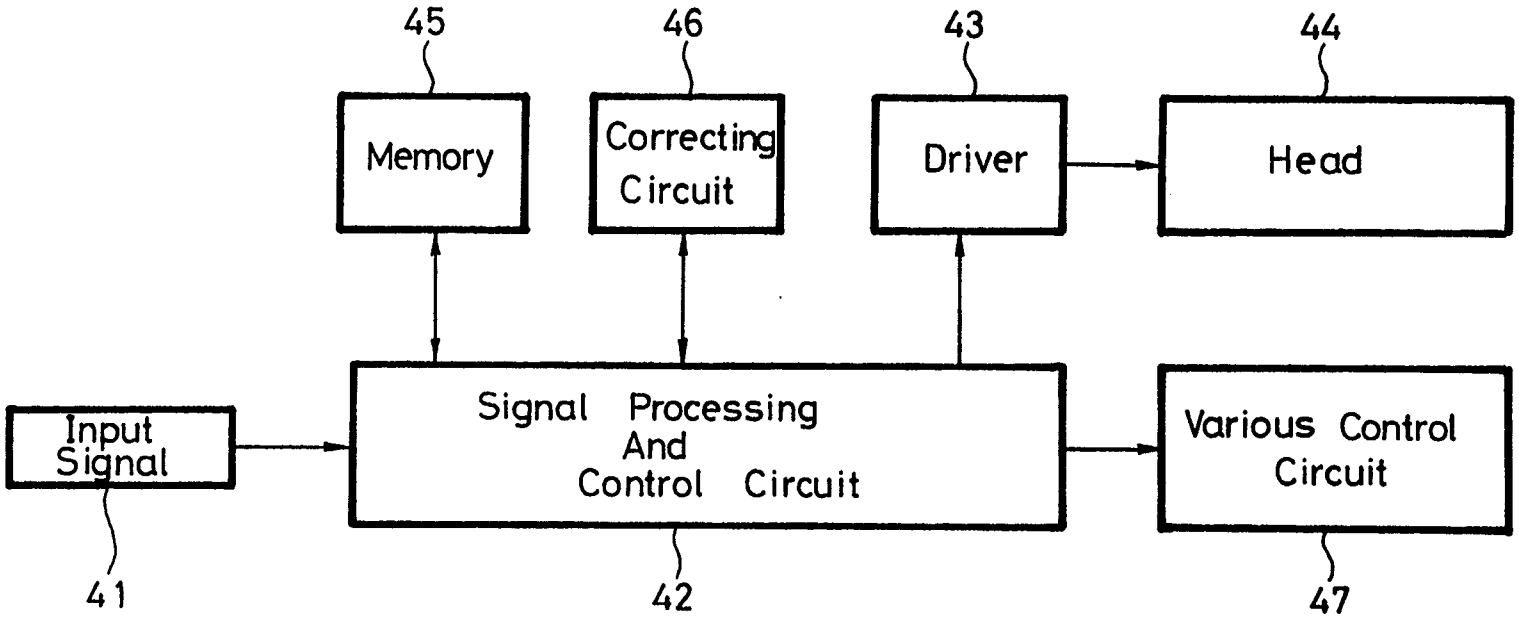
FIG. 9 is a block diagram showing an example of a circuit configuration of a signal processing and controlling system of the ink-jet printers according to the present invention.

FIG. 9 of the accompanying drawings shows in block form a printing and control system for the printer according to the present invention.

As shown in FIG. 9, a signal 41 such as printing data or the like is input to a signal processing and controlling circuit 42, in which it is arranged in the sequential order of the printing and supplied through a driver 43 to a head 44. The printing sequential order is different depending on the structures of the head and the printing unit. Moreover, the printing sequential order is associated with the sequential order of the input printing data so that it is temporarily recorded in a memory 45, such as a line buffer memory and a one-picture memory, and then read out therefrom. A gradation signal and an ink-jetted signal are output to the head 44.

If the head 44 is of the multi-head type having a number of nozzles, an IC is mounted on the head 44 to reduce the number of wirings that are connected to the head 44. A correcting circuit 46 is connected to the signal processing and controlling circuit 42 to effect a gamma correction, a color correction in the color printing, and a fluctuation among respective heads. In general, correction data is stored in the correcting circuit 46 in the form of a ROM (read-only memory) map and the correction data may be read out in accordance with external conditions, such as a nozzle number, a temperature, an input signal or the like.

The signal processing and controlling circuit 42 is formed of a CPU (central processing unit) and a DSP (digital signal processor) so as to process a signal by means of software. The signal thus processed is supplied to a various control unit 47. The various control unit 47 is adapted to control the driving and synchronization of the motors which rotate the rotary drum 23 and the feed screen 24, the cleaning of the head and the supply and eject of the printing paper 22, etc. The signal 41 includes an operation unit signal and an external control signal in addition to the printing data.

Specific examples of the ink-jet print head according to the present invention will hereinafter be described with reference to FIGS. 10A to 10E through FIG. 41. Throughout these figures of the drawings, like parts corresponding to those of FIG. 1 are marked with the same references and therefore need not be described in detail.

FIGS. 10A to 10E and FIGS. 11A to 11E of the accompanying drawings show an example of structures of heads according to the present invention and operation principles thereof, respectively.

Figure 10A:
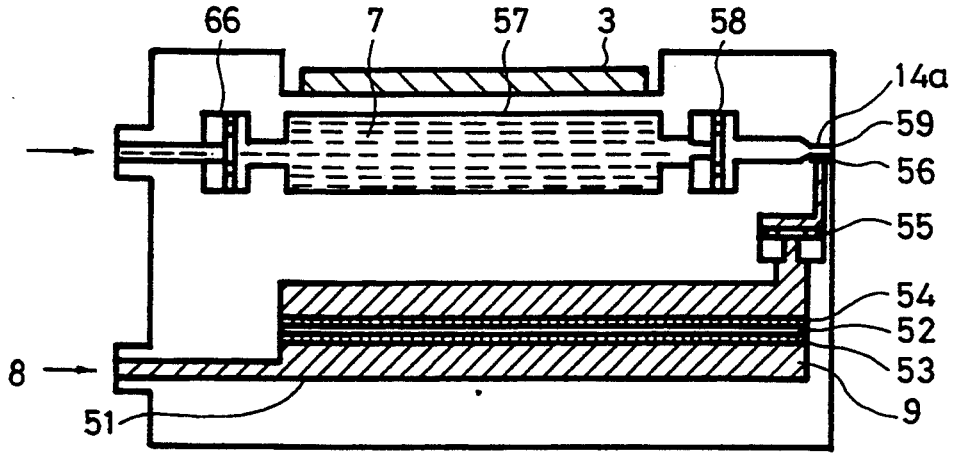
FIGS. 10A through 10E are respectively longitudinal cross-sectional views showing a specific structure and operation of the ink-jet print header according to an embodiment of the present invention.
Figure 12:
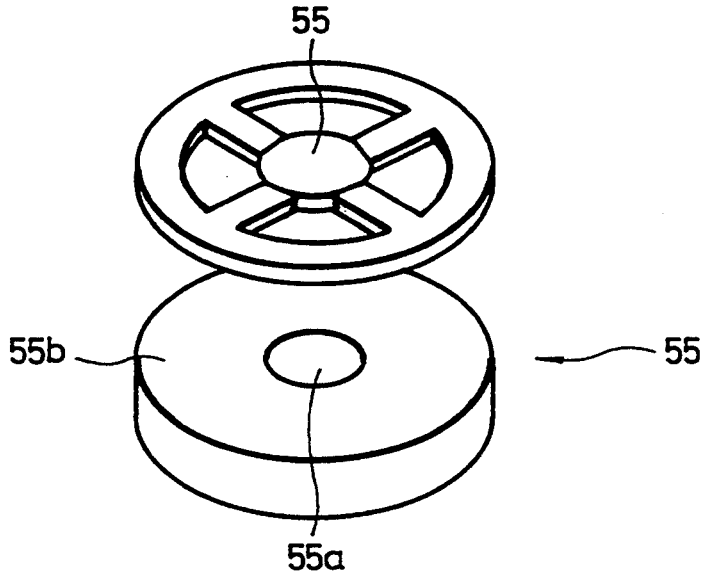
FIG. 12 is a perspective view showing a structure of a one-way valve shown in FIGS. 10A through 10E.
Figure 13:
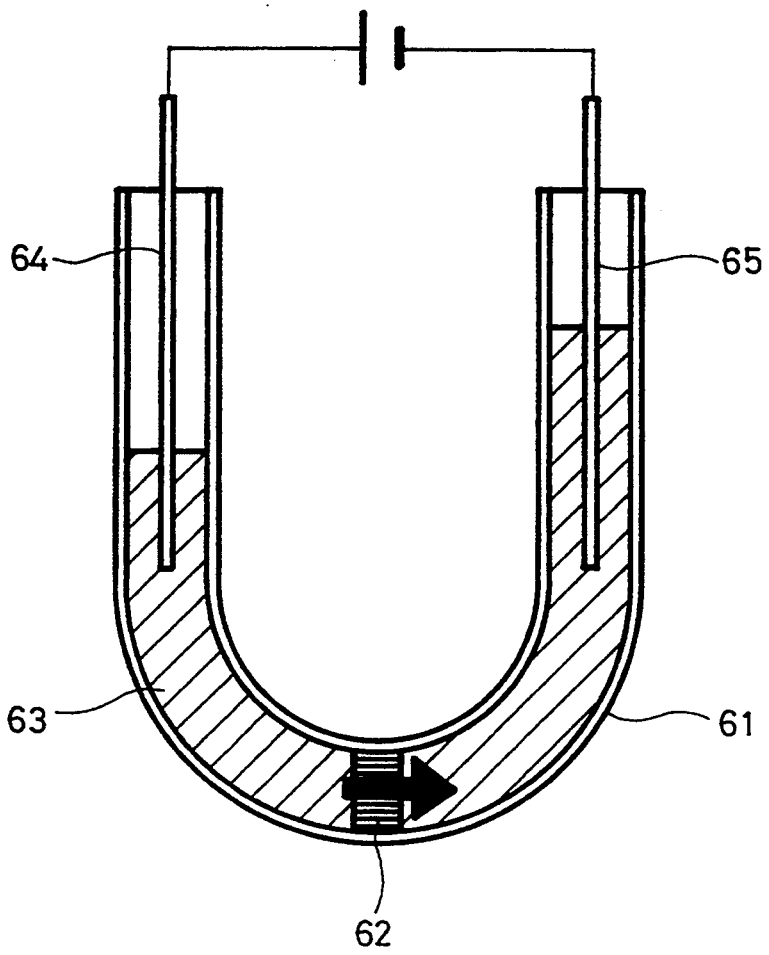
FIG. 13 is a partly cross-sectional side view used to explain an action of an electroosmosis unit shown in FIGS. 10A through 10E.

As shown in FIGS. 10A to 10E and FIG. 11A, the ink 9 is introduced from the ink tank 8 (not shown) and filled into an ink chamber 51. The ink chamber 51 is separated by a first porous membrane 52 to provide to two ink chambers. Metal mesh-electrodes 53, 54, through which the ink 9 can permeate, are fixed to the front and rear surfaces of the first porous membrane 52. The ink 9 is further introduced through a first one-way valve 55 to a second porous membrane 56 as shown in FIG. 10A, for example. As shown in FIG. 12, the one-way valve 55 is composed of a valve seat 55*b* having a through-hole 55*a* at its center and an annular valve plate 55*c* and served to prevent a back current of the ink 9.

On the other hand, the transparent solvent 7 is introduced into the head from a transparent solvent tank (not shown) and then filled into a transparent solvent cavity 57 that is served as a liquid chamber. The transparent solvent 7 is further supplied through a second one-way valve 58 to an ink jetting orifice 59 of the mixing chamber 14*a*. At the ink-jetting orifice 59, the transparent solvent 7 forms a so-called meniscus 60 of crescent shape by its surface tension.

The ink 9 and the transparent solvent 7 are isolated by the second porous membrane 56 and therefore suppressed from being mixed with each other.

Figure 10B:
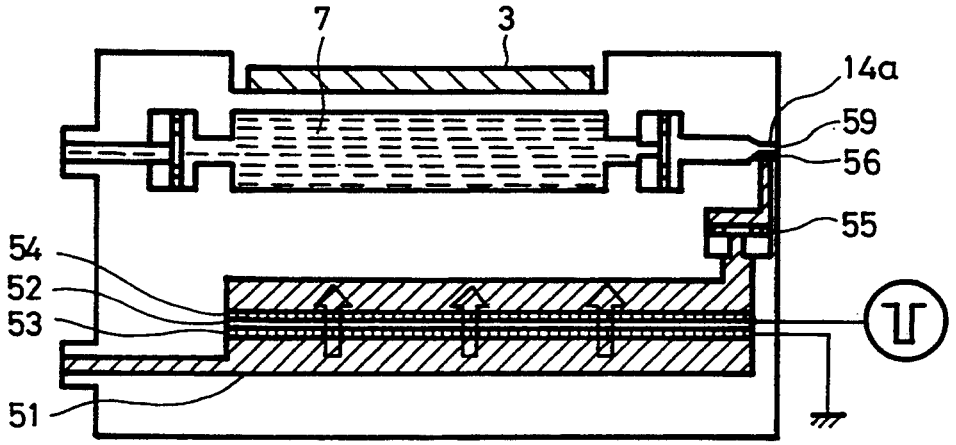

When a negative pulse-shaped DC voltage, for example, is applied across the mesh electrodes 54 and 53 with the mesh electrode 54 being negative relative to the mesh electrode 53, as shown in FIGS. 10B and 11B, the ink 9 of a constant amount is permeated from the mesh electrode 53 side to the mesh electrode 54 side of the ink chamber 51 in an electroosmosis fashion.

The electroosmosis is a phenomenon such that, when a porous diaphragm 62, for example, is disposed at the central porion of an U-letter tube 61 and the U-letter tube 61 is filled with an electrolyte solution 63, if electrode plates 64, 65 are inserted into the U-letter tube 61 from the respective openings and a DC voltage is applied to the electrolyte solution 63 as shown in FIG. 12, then the electrolyte solution 63 is moved through the porous diaphragm 62 from one branch portion to the other branch portion of the U-letter tube 61.

The electroosmosis takes place when an electric double layer is formed on the boundary between the porous diaphragm 62 and the electrolyte solution 63 so that the liquid (electrolyte solution) has a certain potential relative to the solid (porous diaphragm). This potential is what might be called an electrokinetic potential or $\zeta$ potential. This electrokinetic potential is determined depending on the property of the materials of liquid and solid and the condition of the boundary therebetween. A speed at which the liquid is moved in an electroosmosis fashion is proportional to the $\zeta$ potential and the magnitude of the electric field. The permeating amount of the liquid is proportional to an amount of flowed electricity.

Turning back to FIGS. 10B and 11B, an internal pressure of the mesh electrode 54 or the like is increased by the ink 9 which was electrically permeated from the mesh electrode 53 side to the mesh electrode 54 side through the first porous membrane 52 in the ink chamber 51 so that the ink 9 pushes the one-way valve 55 upwardly. Further, the ink 9 is permeated through the second porous membrane 56 into the mixing chamber 14*a*. An amount in which the ink 9 is permeated into the mixing chamber 14*a* can be accurately controlled by the amount of current flowing between the mesh electrodes 53 and 54. In actual practice, it is convenient to control the permeated amount of the ink 9 by using a pulse width of the voltage pulse applied to the mesh electrode 54 from a circuitry standpoint.

A predetermined amount of the permeated ink 9 is immediately ink-jetted as a mixed ink of a predetermined density from the ink-jetting orifice 59 by a pressure caused by driving the piezoelectric element 3 while it is being mixed with the transparent solvent 7 in the mixing chamber 14*a*.

Figure 10C:
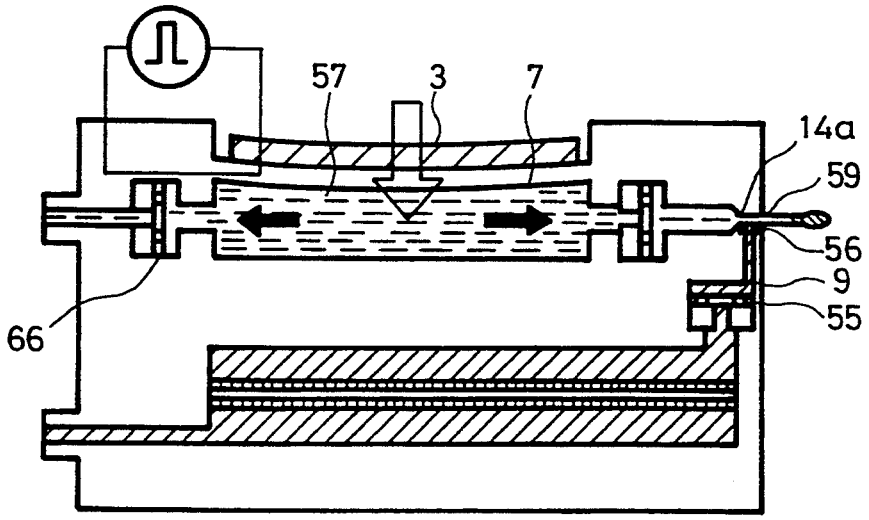

When applied with the voltage pulse, the piezoelectric element 3 is curved as shown in FIGS. 10C and 11C. At the same time, the wall surface of the transparent solvent cavity 57 to which the piezoelectric element 3 is bonded is also curved and the capacity of the cavity 57 is decreased to produce an internal pressure therein. Although the internal pressure is transmitted in the directions shown by solid arrows in FIGS. 10C and 11C, the pressure transmitted to the transparent solvent tank side is blocked by a third one-way valve 66. Then, the pressure is concentrated in the mixing chamber 14*a* and in the ink-jetting orifice 59 direction, whereby the ink can be ink-jetted efficiently. Then, the ink 9 is projected from the ink-jetting orifice 59 in a columnar shape as shown in FIGS. 10C and 11C.

The first one-way valve 55 is adapted to avoid the back current of the ink as earlier noted. In particular, when the ink that was mixed with the transparent solvent 7 is jetted in FIGS. 10C and 11C, the one-way valve 55 can prevent the mixed ink or the transparent solvent 7 from being mixed to the ink side through the second porous membrane 56 due to an ink-jet pressure. The structure of the one-way valve was already illustrated in FIG. 12.

Figure 10D:
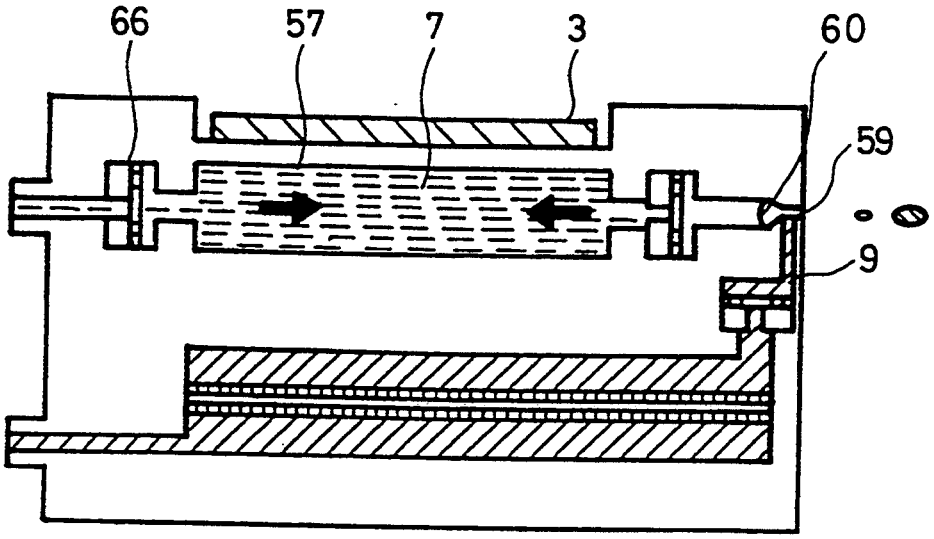

As shown in FIGS. 10D and 11D, when the application of the voltage pulse to the piezoelectric element 3 is turned off, the piezoelectric element 3 is returned to the original shape and the transparent solvent cavity 57 also recovers the original volume so that the internal pressure of the cavity 57 is lowered. As a result, the third one-way valve 66 is opened and hence the transparent solvent 7 is pulled into the cavity 57. At the ink-jetting orifice 59, the projected ink column is cut away. In this case, the mixed ink is separated into a main ink drop 9*a* and a satellite ink drop 9*b* which are then ink-jetted. At that time, the mixed ink must be all contained in the ink-jetted ink drops and must not be left in the transparent solvent 7 that is pulled into the cavity 57. To this end, the amount of the mixed ink thus jetted must be sufficiently larger than the amount of the ink 9 to be mixed.

A mixing ratio of the ink 9, which is selected so that the ink 9 can be prevented from being mixed into the transparent solvent 7 on the cavity 57 side, is proved to be less than 50% by the experiments depending on the ink-jet frequency or the like. More preferably, it is desired that the ink mixing ratio when the maximum density is output is about 30%. Accordingly, in order to obtain the sufficiently maximum density, the density of the ink 9 must be made sufficiently high. Therefore, when the mixing weight % of the ink 9 is 30%, a dye of an amount with which a printing density becomes higher than 1.5 in reflection density is mixed into the ink 9.

Figure 10E:
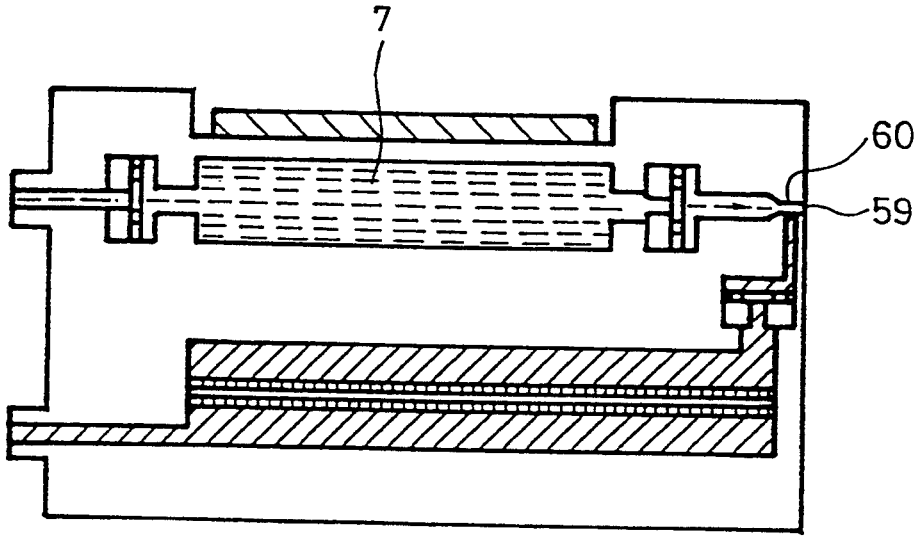

The meniscus 60 of the transparent solvent thus pulled-in is again filled into the ink-jetting orifice 59 due to its capillarity and then returned to the initial state as shown in FIGS. 10E and 11E.

Figure 14:
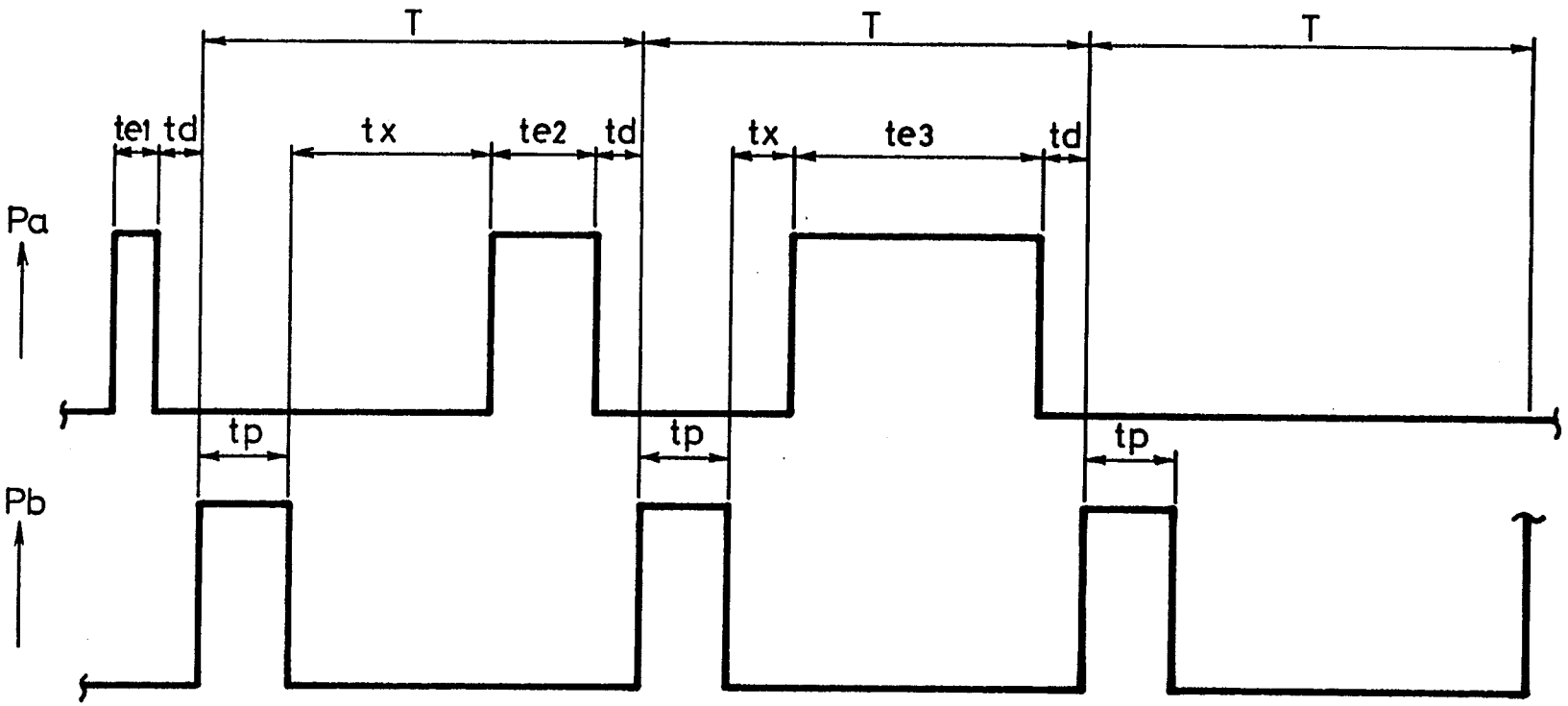
FIG. 14 is a diagram showing an example of voltage pulses used in the electroosmosis process and in the ink-jetting process.

The voltage pulse that is used to push the ink 9 into the mixing chamber 14*a* according to the electroosmosis and the voltage pulse that is used to ink-jet the ink 9 and the transparent solvent 7 within the mixing chamber 14*a* must be applied at certain predetermined timings. In order to prevent the ink 9, which is pushed according to the electroosmosis, from being diffused and mixed into the transparent solvent 7 on the second one-way valve 58 side, when the ink 9 of a predetermined amount is pushed, such ink must be immediately ink-jetted together with the transparent solvent 7. FIG. 14 of the accompanying drawings shows an example of a timing relationship between the electroosmosis voltage pulse Pa and the ink-jet voltage pulse Pb.

A pulse width tei of the electroosmosis voltage pulse Pa is changed as te1, te2, te3 in response to the mixing amount of the ink 9. An ink-jet interval T of the ink 9, a pulse width tp of the ink-jet voltage pulse Pb and a time period td in which the ink-jet voltage pulse Pb is turned on after the electroosmosis voltage pulse Pa was turned off are made constant. Accordingly, the density of the printing dot, i.e., the mixing amount of the ink 9 is controlled based on advanced or delayed timing at which the electroosmosis voltage pulse Pa is turned on. The electroosmosis voltage pulse Pa and the movement of the ink 9 in actual practice are not synchronized completely and the latter is delayed. The delayed timing, i.e., responsiveness is changed with the head and the ink characteristics. The value of the time period td is set to an optimum value that is obtained experimentally.

An interval in which the electroosmosis voltage pulse Pa is turned on after the ink-jet voltage pulse Pb was turned off is changed depending on a timing at which the electroosmosis voltage pulse Pa is turned on. In the vicinity of the ink-jet orifice 59, the transparent solvent 7 is refilled during this interval as earlier described. When the transparent solvent 7 is refilled again, a certain predetermined time tr is required. The value of the time tr depends on the viscosity and surface tension of the ink 9 and the nozzle diameter of the head. The refilling of the transparent solvent 7 must be completed before the ink 9 is pushed into the mixing chamber 14*a* according to the electroosmosis process. To this end, the value of the interval tx must be made larger than the value of the time tr. Although the pulse width tei of the electroosmosis voltage pulse Pa is held at maximum, the interval tx becomes minimum, the value of the interval tx at that time is set to be larger than the value of the time tr.

As already described, the ink 9 and the transparent solvent 7*a* are isolated from each other by the second porous membrane 56 and hence they are restricted from being naturally mixed with each other due to the diffusion. Therefore, in printing, the ink 9 and the transparent solvent 7 can be prevented from being mixed with each other uselessly. Even when the ink 9 and the transparent solvent 7 are left during a long period of time and mixed with each other naturally through the second porous membrane 56, the ink 9 and the transparent solvent 7 are prevented from being diffused more than ever by the first and second one-way valves 55, 58. When the print head is not in use, the ink 9 and the transparent solvent 7 are fundamentally and constantly set the condition such that they can be naturally mixed with each other in the portion sandwiched by the first and second one-way valves 55 and 58. Therefore, before the printing is made, the mixed ink remaining at the portion sandwiched between the first and second one-way valves 55 and 58 must be discharged. When the mixed ink is discharged, the mixed ink remaining in the portion sandwiched by the second one-way valve 58 and the second porous membrane 56 is discharged by driving the piezoelectric element 3 necessary times. Thus, the mixed ink in that portion is replaced with the transparent solvent 7. Then, the mixed ink at the portion sandwiched by the first one-way valve 55 and the second porous membrane 56 is pushed into the mixing chamber 14a according to the electroosmosis process while it is discharged by driving the piezoelectric element 3. According to the above sequence of operation, the portion between the first one-way valve 55 and the second porous membrane 56 is replaced with the ink 9 and the portion between the second one-way valve 58 and the second porous membrane 56 is replaced with the transparent solvent 7, thereby setting the print head in the printing standby mode.

Figure 15:
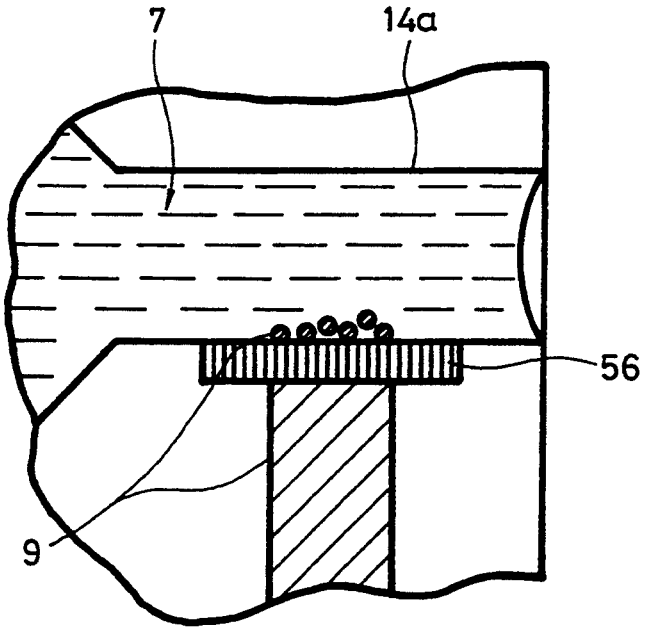
FIG. 15 is an enlarged cross-sectional view of a second porous membrane used in FIGS. 10A through 10E.
Figure 16:
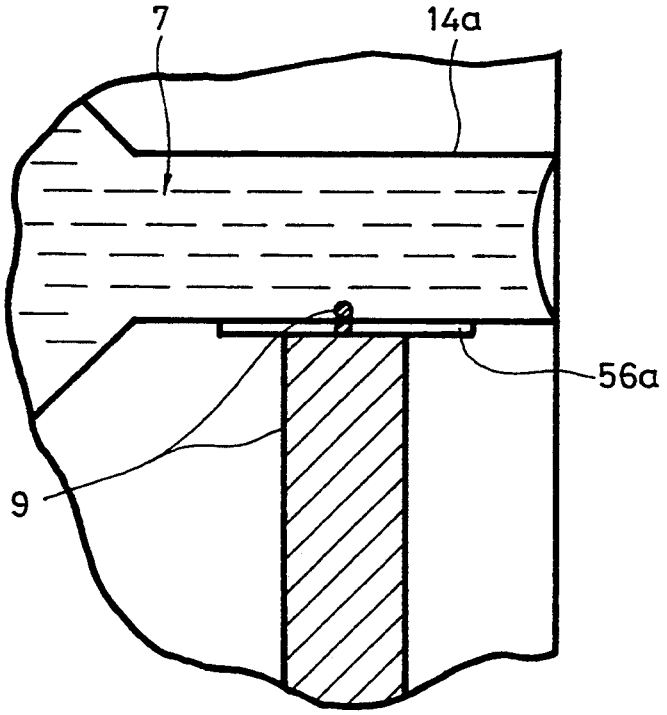
FIG. 16 is an enlarged cross-sectional view showing a very small aperture plate that can be replaced with the second porous membrane shown in FIGS. 10A through 10E.

Another role, played by the second porous membrane 56 is to make the estimation of a very small amount of ink. As shown in FIG. 15, the ink 9 is passed through very small pores of the second porous membrane 56, thereby making it possible to push inks 9 of very small amounts into the mixing chamber 14*a*. The second porous membrane 56 may be replaced with a plate 56*a* having holes of very small diameters as shown in FIG. 16. The diameter of this very small hole is properly selected in a range of from 0.5 μm to 2 μm. Such small holes are formed by irradiating laser beams on a stainless steel thin film having a thickness of 3 μm, for example, according to the excimer laser method.

Also in this case, the role of this hole is to prevent the ink 9 and the transparent solvent 7 from being mixed with each other uselessly and to estimate the ink of the very small amount.

The first porous membrane 52 might be formed of a so-called micro-porous membrane filter. As the material thereof, there can be used cellulose family such as nitrocellulose, acetylcellulose, regenerated cellulose or the like, plastics such as polytetrafluoroethylene, polycarbonate, polyamide, polyethylene or the like, ceramics such as glass, alumina, etc. The above-mentioned materials must not be inflated or damaged by the ink 9 used and can treat the ink 9 in an electroosmosis fashion.

As the ink 9, it is possible to utilize both of water based inks and non-water-based inks. The water-based inks cause electrolysis so that a driving voltage must be set less than an electrolysis voltage (about 1 V). Therefore, the water-based ink cannot increase the electroosmosis speed and is not desirable. Therefore, although the non-water-base ink known as the oil-based ink is preferable, the oil-based ink must have an electroosmotic characteristic for the first porous membrane 52. For nitrocellulose, for example, of the materials which make the above porous membrane 52, there can be utilized such an ink in which quaternary ammonium salt of dodecylbenzensulfonic acid is dissolved into solvent of chlorooctane as electrolyte with a weight ratio of 1 to 5% into which dye, wetting agent, vehicle or the like is added.

The transparent solvent 7 might be a solvent which can be mutually solved with the ink 9 or solvent which cannot. As the material which can be solved mutually with the ink 9, there can be used chlorooctane or chlorooctane to which the wetting agent, vehicle or the like is mixed. As the solvent which cannot be solved mutually with the ink 9, there can be utilized water or water to which the wetting agent, the vehicle or the like is mixed.

If the transparent solvent 7 is made of the solvent which cannot be mutually solved with the ink 9, then the ink 9 is not completely diffused into the transparent solvent 7 so that the transparent solvent 7 is mainly served as a carrier for carrying the ink 9 to the paper (not shown). An image to be printed becomes an image whose tone is expressed by the change of size of ink dot, i.e., the area of the ink dot. In this case, the ink 9 is not mixed into the transparent solvent 7 so that the ink 9 can be prevented from being naturally mixed into the transparent solvent 7 due to diffusion or the ink 9 can be prevented from being mixed toward the transparent solvent cavity 57 side when the ink 9 is pushed into the mixing chamber 14*a* according to the electroosmosis process.

If the transparent solvent 7 is made of the solvent which can be mutually solved with the ink 9, then the ink 9 is satisfactorily diffused into the transparent solvent 7 and the density of the mixed ink drop becomes uniform. Therefore, the printed image becomes such one whose tone is expressed by the concentration of the dot, thereby obtaining higher image quality.

When the print head is in the standby mode, the transparent solvent 7 which does not contain a dye is exposed at the ink-jet orifice 59 unlike the conventional ink-jet print head. Accordingly, if a pure water is used as the transparent solvent 7, for example, then precipitation and viscosity of dye or the like does not occur due to evaporation of the ink solvent unlike the prior art. Consequently, a probability such that the ink-jet orifice 59 is stopped is considerably reduced, which is a large advantage achieved by the head of the present invention.

It is preferable that the metal mesh electrodes 53, 54 are made of a metal so as not to react with materials in the ink 9 uselessly. The metal mesh electrodes 53, 54 may be formed such that iron mesh with a thickness of 50 μm and a pitch of 100 μm is treated by the nickel plating and then further treated by the plating of platinum, gold or the like. Alternatively, the front and rear surfaces of the first porous membrane 52 are directly treated by the deposition process of gold, for example, which can be employed as the electrodes.

The second porous membrane 56 is adapted, as earlier described, to delay the speeds of the diffusion and mixing of the ink 9 and the transparent solvent 7 so as to prevent the ink 9 and the transparent solvent 7 from being mixed with each other uselessly and to estimate the ink 9 of very small amount. As the material of the second porous membrane 56, there can be used plastics such as polytetrafluoroethylene (manufactured under the tradename of Teflon), polyethylene, polyamide or the like, cellulose such as nitrocellulose, acetylcellulose, regenerated cellulose or the like and ceramics such as glass, alumina or the like. Similarly to the first porous membrane 52, the second porous membrane 56 must also be prevented from being damaged and inflated by the ink 9 and the transparent solvent 7. Accordingly, in the case of the plastics, plastics material such as Teflon or the like which can resist solvents are preferable. Also, ceramic materials such as glass, alumina or the like are suitable in use. In this case, these materials does not need electroosmosis. The aperture diameter of the porous membrane is preferably selected in a range of from 0.1 μm to 10 μm or more preferably in a range of from 0.5 μm to 2 μm depending on the compositions of the ink 9 and the transparent solvent 7 from the consideration such that they can be prevented from being mixed or that they can be passed through the second porous membrane 56.

A material which forms the print head body must resist solvents utilized in the ink 9 and the transparent solvent 7. By way of example, the print head body might be made of plastics material such as polyethylene, polypropylene, polyterafluoroethylne or the like, ceramics material such as glass, alumina or the like, metal such as stainless steel or the like.

Figure 17:
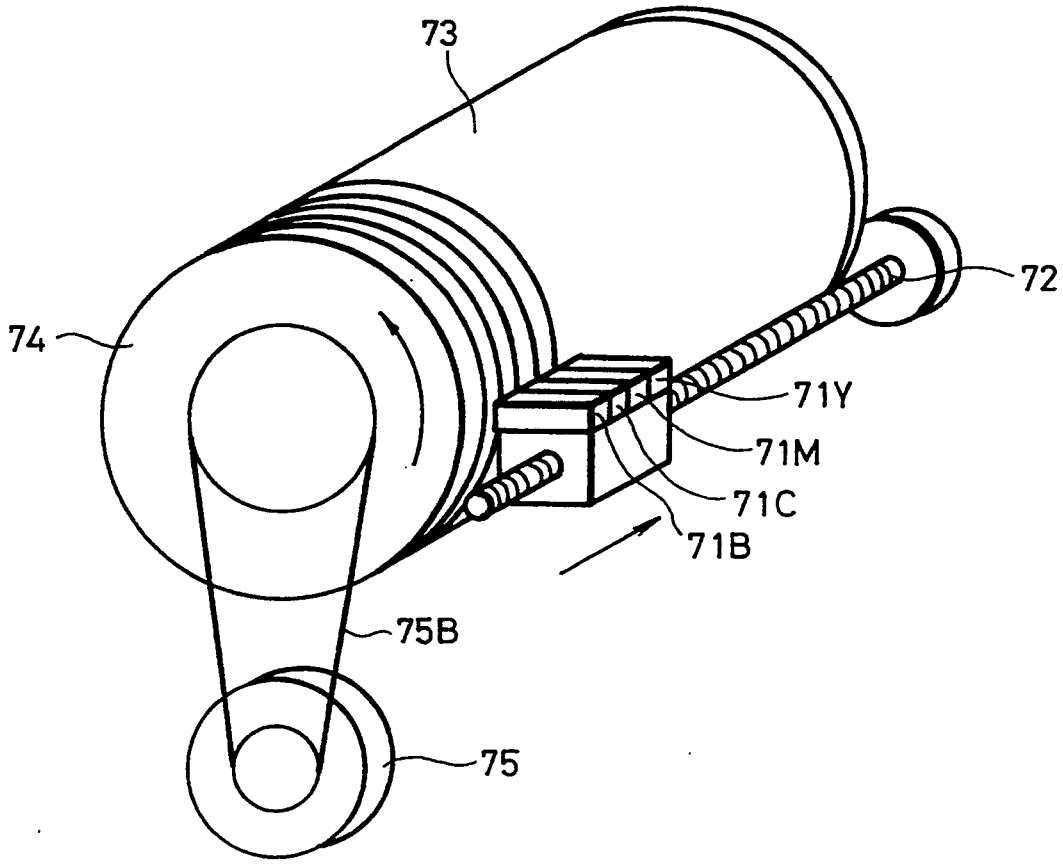
FIG. 17 is perspective view showing a structure of an exemplary full color ink-jet printer according to the present invention.

FIG. 17 illustrates an example of a structure in which a full color ink-jet printer is formed by utilizing the above-mentioned ink recording head.

As shown in FIG. 17, heads 71Y, 71M, 71C and 71BK of respective colors such as yellow, magenta, cyan and black are disposed on a lead screw 72. A paper 73 is wrapped around a drum 74 and fixed thereto. While the drum 74 is being rotated by a motor 75 through a belt 75B to move in the axial direction of the drum 74, ink drops of respective colors of predetermined densities are ink-jetted from the head 71 to print an image or the like on the paper 73. In this case, the printing is made in a spiral fashion. Alternatively, the head 71 may be moved stepwise by one line per revolution of the drum 74.

Such ink recording head as described above may be modified as a so-called multi-head structure which includes a plurality of ink-jet orifices. In this case, only the portions that permeate the ink according to the electroosmosis process are arranged as a multi-head arrangement and other portion that jets the transparent solvent may be formed as a common structure. That is, ink density per dot may be controlled according to the electroosmosis process and a plurality of ink dots or all ink dots may be ink-jetted simultaneously. The ink-jet of the ink need not be controlled at every dot.

Further, the following head is also possible. In this head, three kinds of inks such as yellow ink, cyan ink and magenta ink are mixed within the same nozzle and then ink-jetted. Accordingly, when a neutral tint is reproduced, the neutral tint is generally reproduced by using a combination of dots of printed respective colors. According to this head, a particular neutral tint can be produced at the unit of dot. Further, when respective colors are recorded by independent heads, a mechanical adjustment of high accuracy (error of about 30 μm in the case of 400 DPI (dot per inch)) is required so as to avoid a so-called color shading. Such mechanical adjustment is not required in this head.

The ink recording head thus arranged has the advantages which follow.

Firstly, since the high tone recording can be made at unit of pixel, there is then the advantage such that the continuous tone recording of high definition can be carried out. The density can be increased at the unit of dot, which was impossible according to the prior art.

Secondly, the ink estimating mechanism of high accuracy can be realized with a simple structure. That is, by effectively utilizing the electroosmosis, the ink estimating pump can be made by a combination of only the porous membranes and the electrodes. In addition, since the permeated amount of the ink is only proportional to the amount of electricity flowing between the electrodes, even an ink of very small amount can be estimated accurately. The above-mentioned ink recording head can be modified as the multi-head type with ease.

Thirdly, this ink recording head is difficult to stop the ink. According to the conventional ink-jet head, the ink is exposed at the ink-jet orifice so that, if the ink-jet head is left as it is for a long period of time, there is then the problem such that the dye is precipitated at the orifice by the evaporation of the ink solvent to thereby cause the ink to be stopped. However, according to the ink recording head of the present invention, since the transparent solvent is exposed at the ink-jet orifice and the ink is not exposed when the ink recording head is in the standby mode, there is then no risk that the ink is not stopped by the precipitation of the dye. As already described, even if the ink is naturally mixed into the transparent solvent, then the density of the mixed ink exposed on the orifice is considerably lowered as compared with that of the prior art. Therefore, there is the small probability that the ink is stopped. Further, if a head cap is used together with the head like the prior art, then the ink can be prevented from being stopped more reliably.

Embodiments of the present invention wherein an opening and closing mechanism is provided at the ink supply orifice of the mixing chamber 14a of the ink-jet print head shown in FIGS. 10 and 11 to thereby prevent the ink 9 and the transparent solvent 7 from being naturally mixed will be described below with reference to the drawings which follow.

Figure 18A:
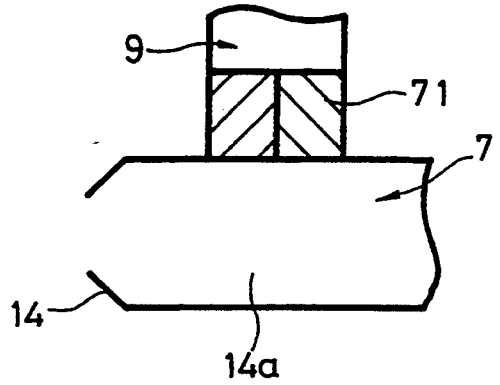
FIGS. 18A and 18F are respectively fragmentary cross-sectional side views showing a fundamental structure of an opening and closing unit disposed at the ink supplying opening according to the embodiment of the ink-jet print head of the present invention.
Figure 18B:
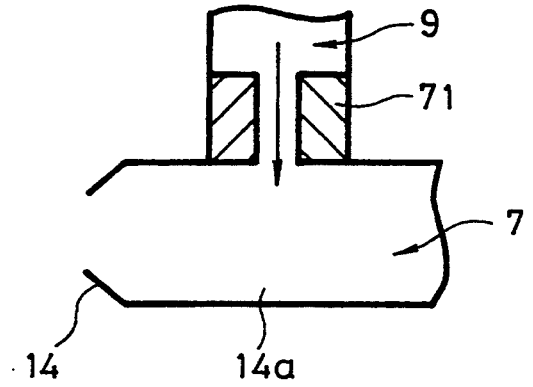

FIGS. 18 through 32 show structures and actions of the embodiments of the present invention. FIGS. 18A and 18B of the accompanying drawings show fundamental structures of the embodiments of the present invention.

An opening and closing unit 71 serving as an opening and closing mechanism is provided at the ink supply orifice through which the ink 9 is supplied to the mixing portion 14*a* into which the transparent solvent 7 is filled. In the standby mode of the print head, as shown in FIG. 18A, the opening and closing unit 71 is closed to prevent the ink 9 from being mixed into the transparent solvent 7. When the ink 9 is mixed in the transparent solvent 7, as shown in FIG. 18B, the opening and closing unit 71 is opened. When the mixed ink is ink-jetted, if the opening and closing unit 71 is closed, then the ink 9 and the transparent solvent 7 can be prevented from being mixed uselessly due to the change of ink-jet pressure. Moreover, if the operation of the opening and closing unit 71 is controlled in an analog fashion or if the pulse width modulation is employed, then the opening and closing unit 71 can be given the ink estimating function. In this case, the ink 9 is applied with a certain constant pressure.

FIGS. 19 through 28 of the accompanying drawings show examples of a variety of structures by the opening and closing unit 71. In the example shown in FIGS. 19 and 20, a valve seat 72 and a piezoelectric element 73 are located in an opposing relation to each other. By applying a voltage across the electrodes 73*a* of the piezoelectric element 73, a thickness t of the piezoelectric element 73 is changed to change a spacing between the piezoelectric element 73 and the valve seat 72, thereby opening and closing the path through which the ink 9 is flown. The piezoelectric element 73 may be replaced with a magnetostriction element.

Figure 19:
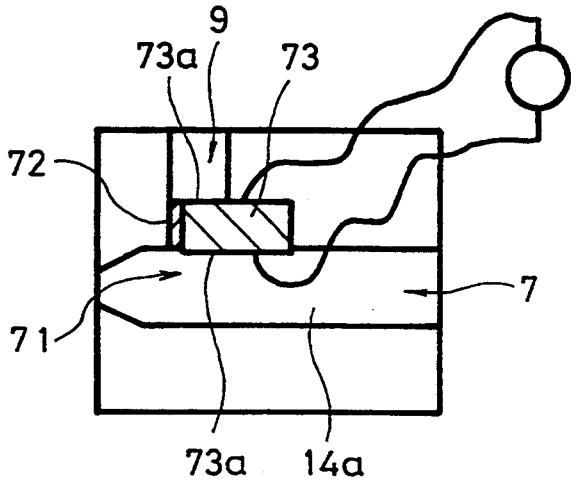
FIG. 19 is a fragmentary cross-sectional side view showing a structure of a first example of the opening and closing unit shown in FIGS. 18A and 18B.
Figure 20:
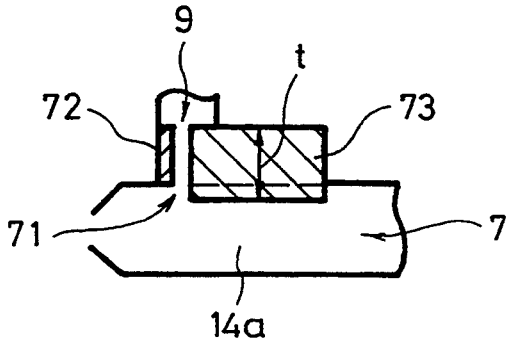
FIG. 20 is a fragmentary cross-sectional side view used to explain operation of the opening and closing unit shown in FIG. 19.
Figure 21:
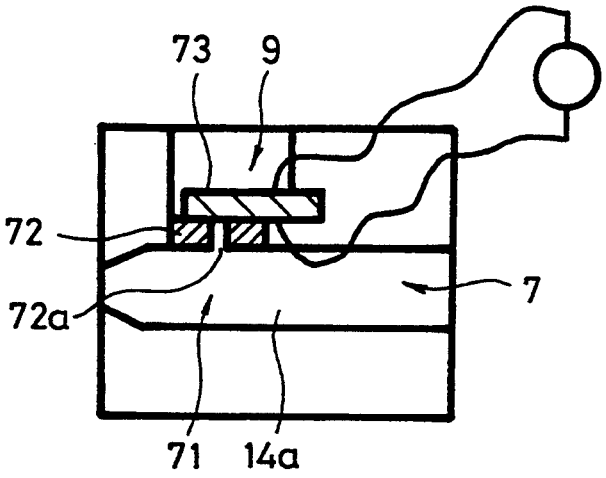
FIG. 21 is a fragmentary cross-sectional side view showing a structure of a second example of the opening and closing unit shown in FIGS. 18A and 18B.
Figure 22:
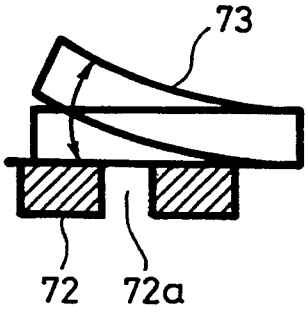
FIG. 22 is a fragmentary cross-sectional side view used to explain operation of the opening and closing unit shown in FIG. 21.
Figure 23:
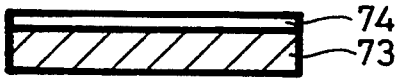
FIG. 23 is a side view showing a structure of a monomorph used in the present invention.
Figure 24:
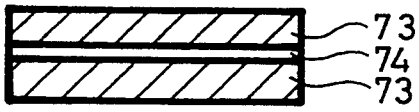
FIG. 24 is a side view showing a structure of a bimorph used in the present invention.

In the example shown in FIGS. 21 to 24, a throughhole 72*a* bored through the valve seat 72 is opened and closed by a warp of the piezoelectric element 73. As shown in FIGS. 19 and 20, when the change of the thickness t of the piezoelectric element 73 is effectively utilized, the changed amount of the thickness t of the piezoelectric element 73 is very small, which requires the piezoelectric element 73 of large size. In the examples of FIGS. 21 to 24, if a monomorph in which a metal 74 is bonded to one surface of the piezoelectric element 73 as shown in FIG. 23 is utilized or if a bimorph in which the piezoelectric element 73 is bonded to both surfaces of the metal 74 is utilized as shown in FIG. 24, the amount in which the piezoelectric element 73 is warped can be increased.

Figure 25:
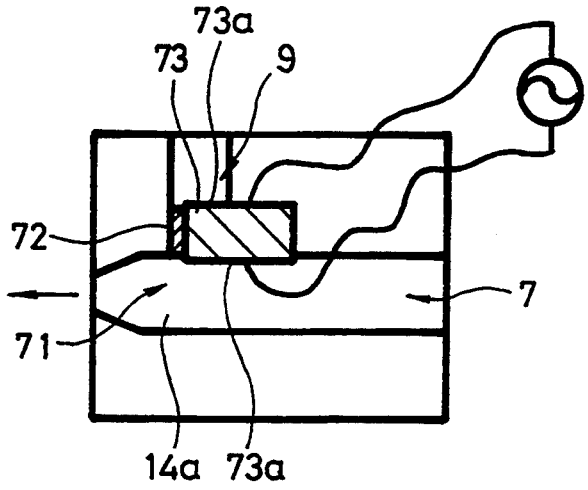
FIG. 25 is a fragmentary cross-sectional side view showing a structure of a third example of the opening and closing unit shown in FIGS. 18A and 18B.
Figure 26:
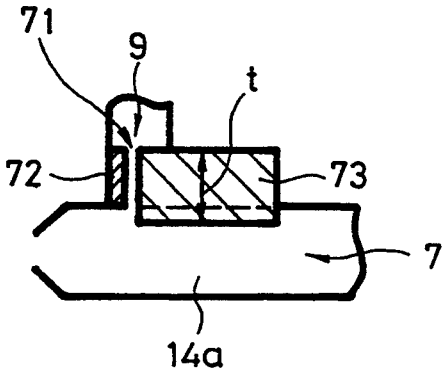
FIG. 26 is a fragmentary cross-sectional side view used to explain operation of the opening and closing unit shown in FIG. 25.

In the example shown in FIGS. 25 and 26, an AC voltage is applied across the electrode 73*a* of the piezoelectric element 73 in the example shown in FIGS. 19 and 20 to cause the ultrasonic vibration in the piezoelectric element 73, thereby opening and closing the ink flowing path. In this case, the ink 9 and the transparent solvent 7 can be mixed with each other readily. In particular, when the ink 9 and the transparent solvent 7 have no affinity therebetween, the above-mentioned effect becomes more effective. If the above ultrasonic vibration is applied to the example shown in FIGS. 21 and 22, similar effects can be achieved.

Figure 27:
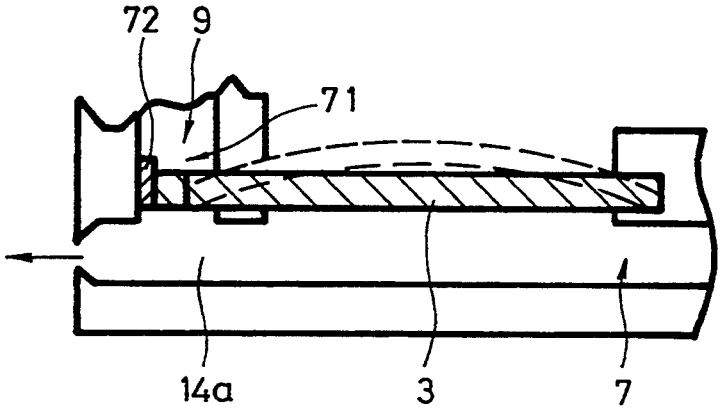
FIG. 27 is a fragmentary cross-sectional side view showing a structure of a fourth embodiment of the opening and closing unit shown in FIGS. 18A and 18B.
Figure 28:
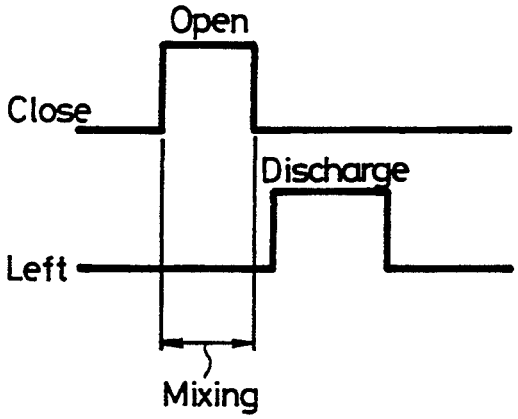
FIG. 28 is a fragmentary cross-sectional side view used to explain operation of the opening and closing unit shown in FIG. 27.

In an example shown in FIG. 27, one end of the piezoelectric element 3 serving to exhaust the ink shown in FIG. 10 is fixed and the other end is projected into the ink supplying orifice as the free end. FIG. 27 illustrates the example in which the bimorph or monomorph structure is employed as the ink exhausting piezoelectric element. In the exhaust preparation, the piezoelectric element 3 is warped progressively to produce a spacing between it and the valve seat 72 as shown by a dashed line in FIG. 27 so that the ink 9 is supplied into the mixing unit 14*a*, wherein it is mixed into the transparent solvent 7. When the ink 9 is exhausted, the piezoelectric element 3 is rapidly returned to the original state as shown by a solid line in FIG. 27, and hence the mixed liquid is exhausted by the pressure caused by the return movement of the element 3. Since the opening and closing unit 71 is closed in this condition, the ink 9 and the transparent solvent 7 can be prevented from being mixed with each other naturally. FIG. 28 shows operation timings of the opening and closing operation of the opening and closing unit 71 and the exhausting operation of the mixed liquid. That is, as shown in FIG. 28, the opening and closing portion 71 is opened only during the period in which the ink 9 and the transparent solvent 7 are mixed. When the mixed ink is discharged or when the print head is in the standby mode, the opening and closing unit 71 is closed.

Figure 29:
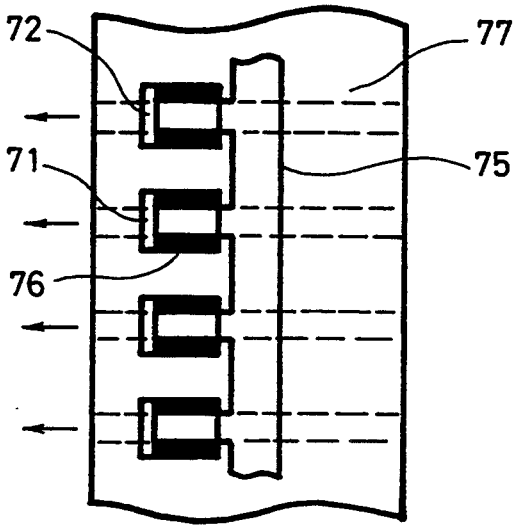
FIG. 29 is a plan view showing an example of a structure in which a nozzle having the opening and closing portion shown in FIG. 18 is formed as a multi-type nozzle.

FIG. 29 shows the case such that the nozzle 14 is formed as the multi-nozzle. As shown in FIG. 29, convex portions of a comb-shaped piezoelectric element 75 are respectively disposed in ink supplying paths 76 to open and close the opening and closing units 71. Electrodes are disposed on the upper and lower surfaces of the piezoelectric element 75. If a common electrode is disposed on one surface and other surface is separated at every convex portion, then the respective ink supplying paths 76 can be independently opened and closed. Further, if common electrodes are disposed on both surfaces, then all ink supplying paths 76 can be opened and closed simultaneously. In FIG. 29, reference numeral 77 designates a transparent solvent flowing path.

Figure 30:
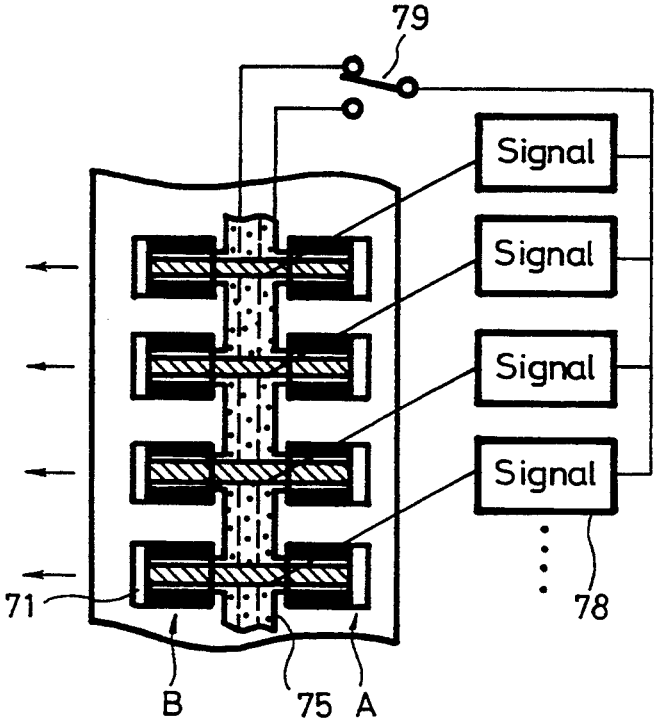
FIG. 30 is a plan view showing an example of a structure in which two colors are simultaneously mixed with each other by the multi-nozzle shown in FIG. 29.
Figure 31:
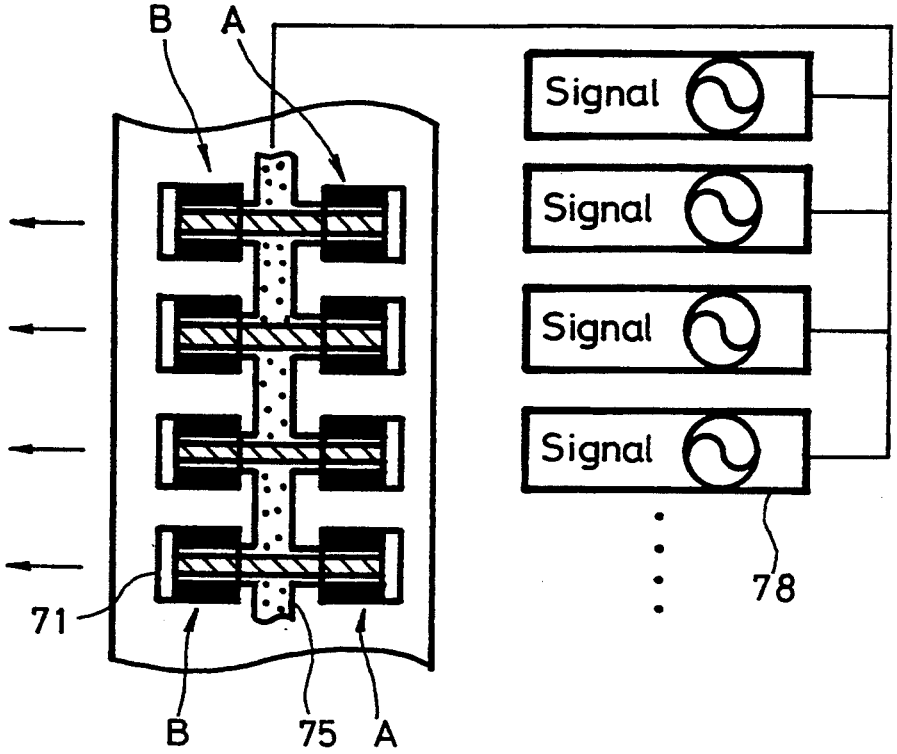
FIG. 31 is a plan view showing a structure of another example of FIG. 30.

FIGS. 30 and 31 show examples in which the mixing unit 14*a* includes a plurality of ink supplying orifices to mix and exhaust inks of two colors simultaneously. As shown in FIGS. 30 and 31, electrodes corresponding to the nozzles are disposed on one surface of the piezoelectric element 75 and two common electrodes corresponding to colors A and B are disposed on the other surface of the piezoelectric element 75 across each nozzle. Then, a duration in which the opening and closing units 71 are held in the opened state is controlled by a signal 78 in response to the ink mixing amount of each nozzle. In the example shown in FIG. 30, after the ink of the color A is mixed into the transparent solvent by a color change-over switch 79, the color change-over switch 79 is switched to the color B side to thereby mix the ink of the color B into the transparent solvent that was mixed with the ink of the color A. That is, after the ink of the color A is mixed into the transparent solvent, the ink of the color B is mixed into the transparent solvent and then the mixed ink is exhausted. Also, the opening and closing unit 71 is served also as an ink estimating unit. Accordingly, if the ink estimating unit is separately provided, then all opening and closing units may be opened and closed simultaneously. If the ink estimating units separately provided are adapted to sequentially estimate the inks at every color, the electrodes provided at every nozzle are made common and the color switching electrodes can be controlled with ease.

Figure 32:
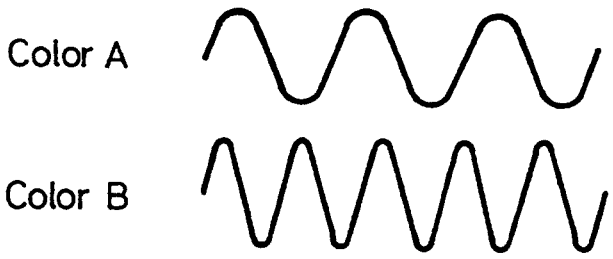
FIG. 32 is a diagram of waveforms of the multi-nozzle signals shown in FIG. 31.

FIG. 31 shows an example in which valves of the opening and closing units 71 are adapted to resonate and resonance frequencies thereof are made different at every color. In this example, the resonance frequencies are varied by changing the lengths of the respective valves. As shown in FIG. 32, if only the ink of the color A is mixed, then a frequency of color A, e.g., low frequency is applied to the piezoelectric element 75 as a signal, while if the ink of the color B is mixed, then a frequency of color B, e.g., high frequency is applied to the piezoelectric element 75 as a signal. A mixing amount is controlled on the basis of a duration of the waveform. Further, signals of frequencies corresponding to a plurality of colors may be superimposed and applied to the piezoelectric element 75 at the same time. Furthermore, the valve itself may not have a resonance function but a valve having a resonance structure may be resonated by a piezoelectric element or the like from the outside. Incidentally, the number of colors is not limited two.

Figure 33A:
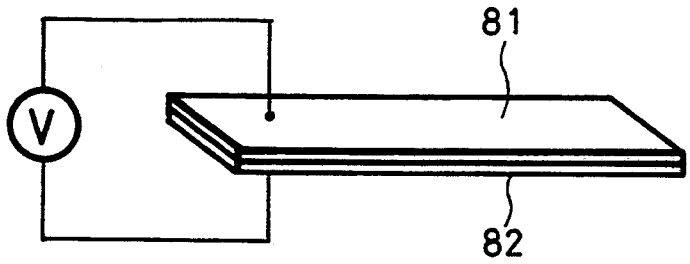
FIG. 33A is a perspective view showing a structure of an example of a series-type actuator used in the present invention.
Figure 33B:
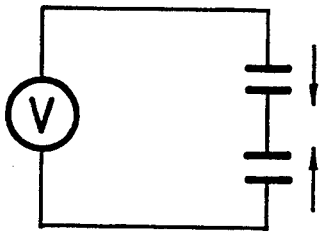
FIG. 33B is a circuit diagram of FIG. 33A.
Figure 34A:
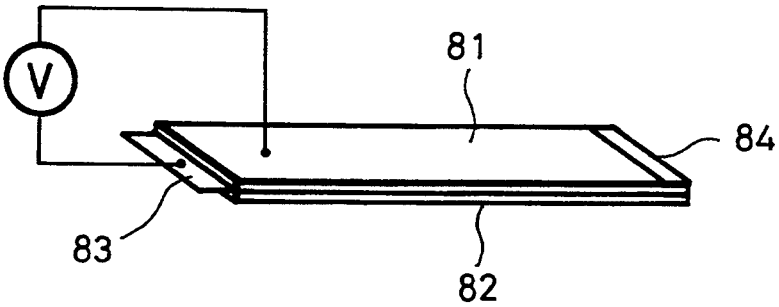
FIG. 34A is a perspective view showing a structure of an example of a parallel-type actuator used in the present invention.
Figure 34B:
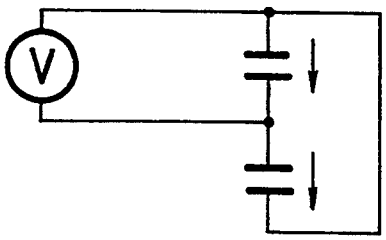
FIG. 34B is a circuit diagram of FIG. 34A.

The piezoelectric element, utilized in the aforementioned respective embodiments will be described. The piezoelectric element is an actuator which makes effective use of ceramics having a piezoelectric property, and is made of typically lead zirconate titanate (PZT). The bimorph is formed by bonding two thin plates of the piezoelectric ceramics and may be classified as a series type bimorph shown in FIGS. 33A and 33B and as a parallel type bimorph shown in FIGS. 34A and 34B on the basis of an interconnection method thereof. In the series type bimorph shown in FIGS. 33A, 33B, a voltage is applied between two ceramic plates 81, 82. In the parallel type bimorph shown in FIGS. 34A, 34B, a resilient metal plate 83 is inserted between the two ceramic plates 81, 82, the ceramic plates 81, 82 are coupled by means of a metal foil 84 and a voltage is applied between one ceramic plate 81 and the resilient metal plate 83. Throughout FIGS. 33A, 33B and FIGS. 34A, 34B, arrows show polarization directions.

Figure 35:
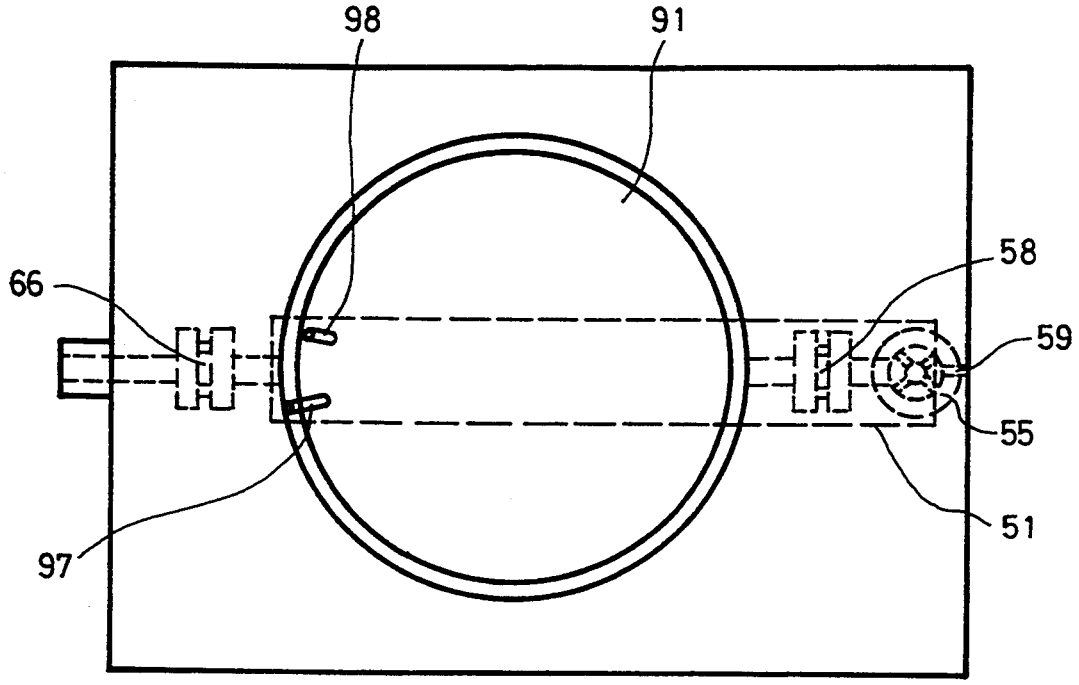
FIG. 35 is a plan view showing a structure of an example of an ink-jet print head that utilizes the series-type actuator.
Figure 36:
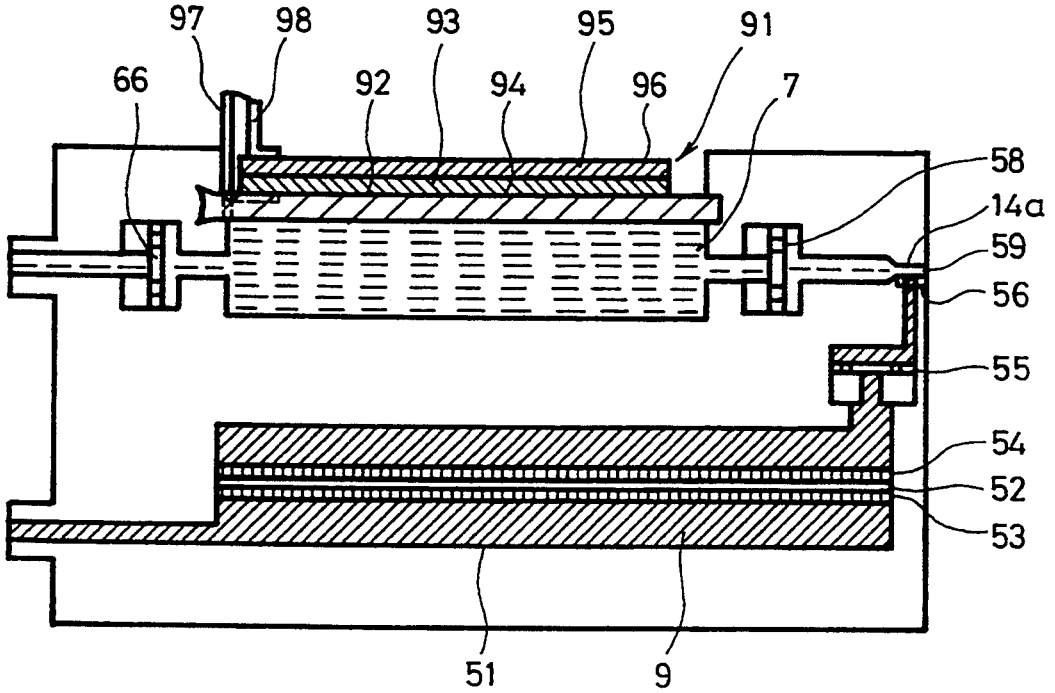
FIG. 36 is a longitudinal cross-sectional view of FIG. 35.

FIGS. 35 and 36 show an example of a ink-jet print head in which a series type bimorph 91 is utilized in the ink-jet print head shown in FIG. 10. As shown in FIGS. 35, 36, the bimorph 91 has a structure in which an electrode 92, a ceramic plate 93, an electrode 94, a ceramic plate 95 and an electrode 96 are laminated, in that order. Polarization directions of the ceramic plates 93, 95 are opposed. Reference numerals 97, 98 depict interconnection wires thereof and the bimorph 91 is deformed by applying a voltage between the interconnection wires 97, 98.

Figure 37:
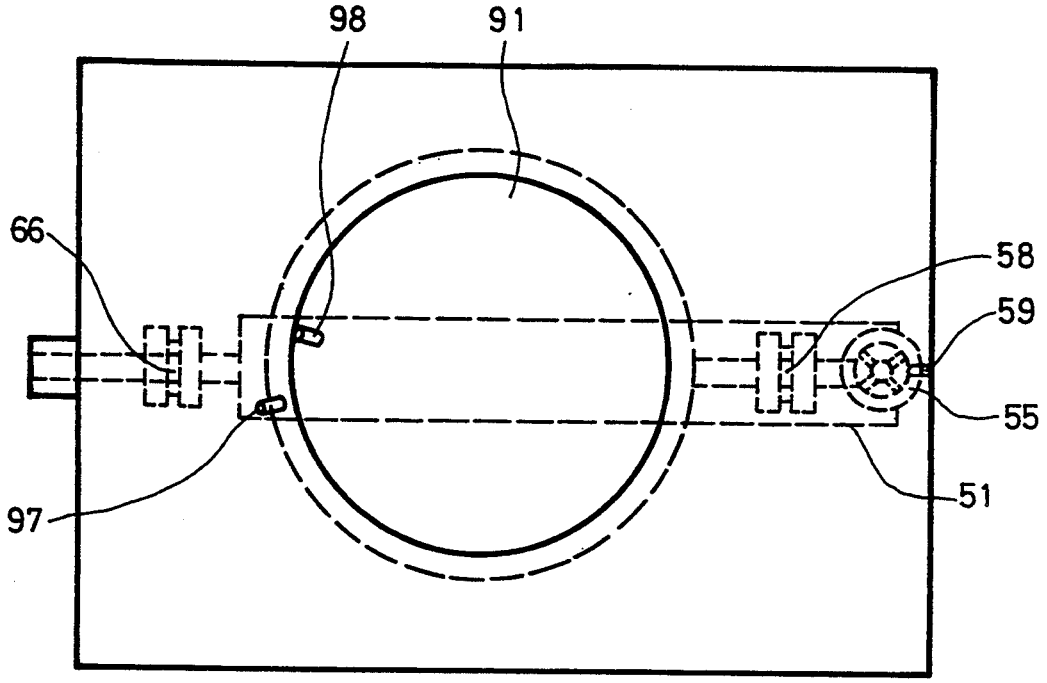
FIG. 37 is a plan view showing a structure of an example in which the location of the bimorph in FIG. 35 is changed.
Figure 38:
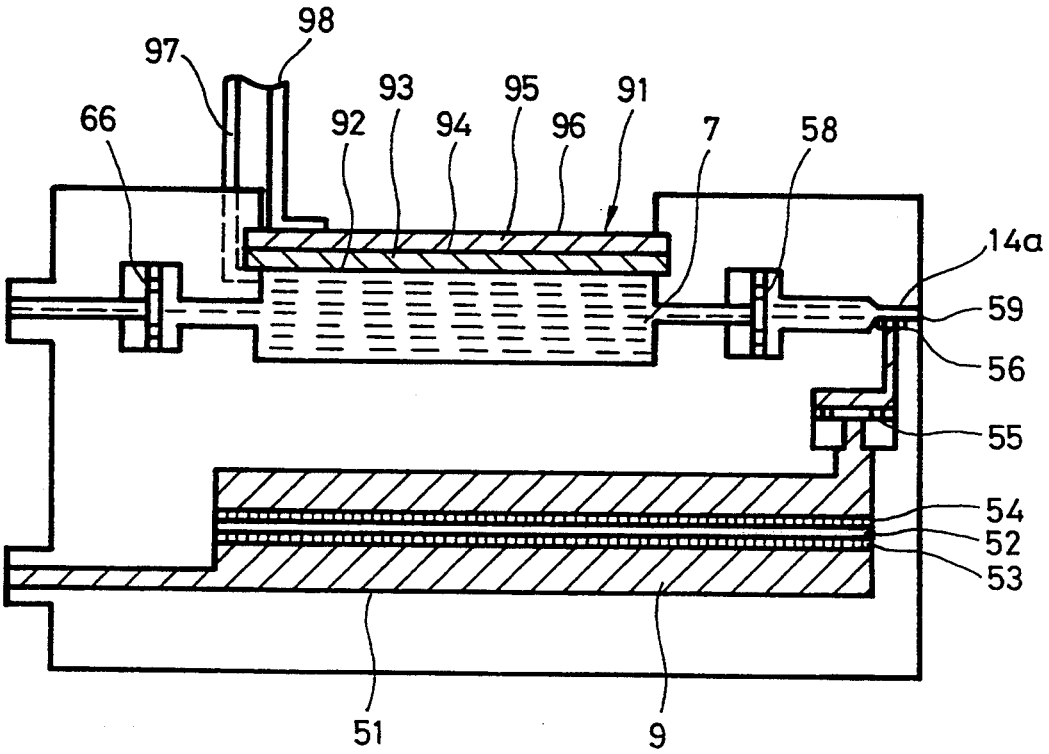
FIG. 38 is a longitudinal cross-sectional view of FIG. 37.

FIGS. 37 and 38 show an example in which the bimorph 91 in FIGS. 35 and 36 is disposed at different position. In this example, the electrode 92 is brought in contact with the transparent solvent 7. Therefore, the electrode 92 is made of an inert metal such as gold, platinum or the like and it is preferable that the electrode 92 is plate by gold, platinum or the like.

Figure 39:
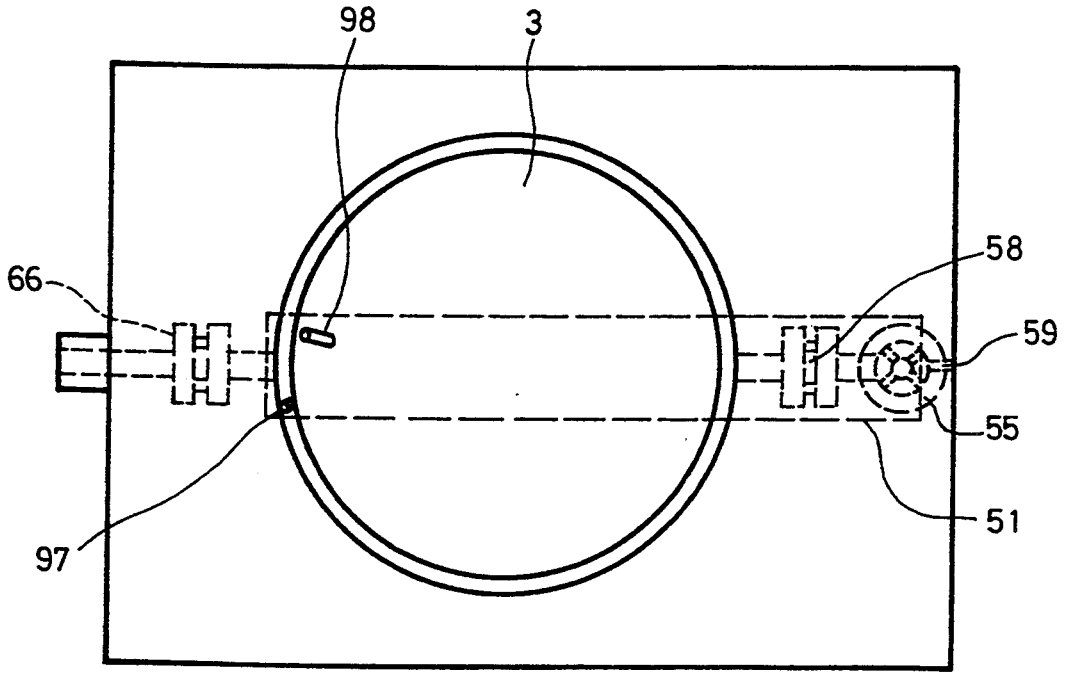
FIG. 39 is a plan view showing a structure of an example of an ink-jet print head that utilizes a piezoelectric element actuator having a single layer structure.
Figure 40:
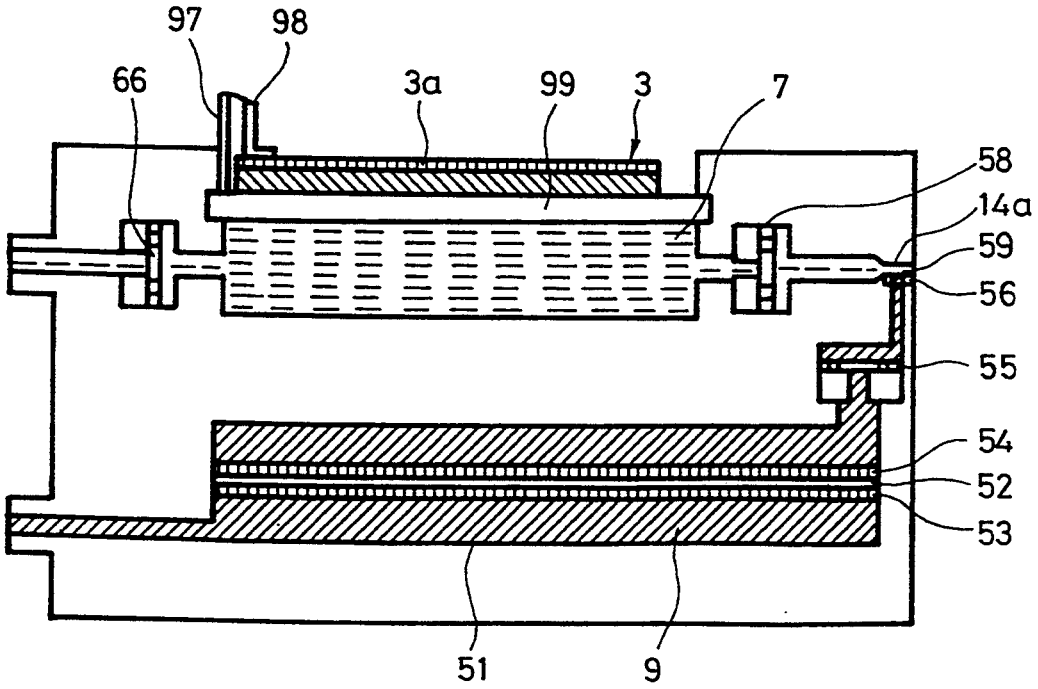
FIG. 40 is a longitudinal cross-sectional view of FIG. 39.

FIGS. 39 and 40 show an example in which the bimorph is replaced with a piezoelectric element having a single layer structure. As shown in FIGS. 39 and 40, the piezoelectric element 3 is bonded to a diaphragm 99 made of a stainless steel or the like and the interconnection wires 97, 98 are respectively interconnected to the diaphragm 99 and the electrode 3*a* of the piezoelectric element 3. When a voltage is applied to the spacing between the interconnection wires 97 and 98, then the diaphragm 99 and the piezoelectric element 3 are curved to extrude the transparent solvent 7.

Figure 41:
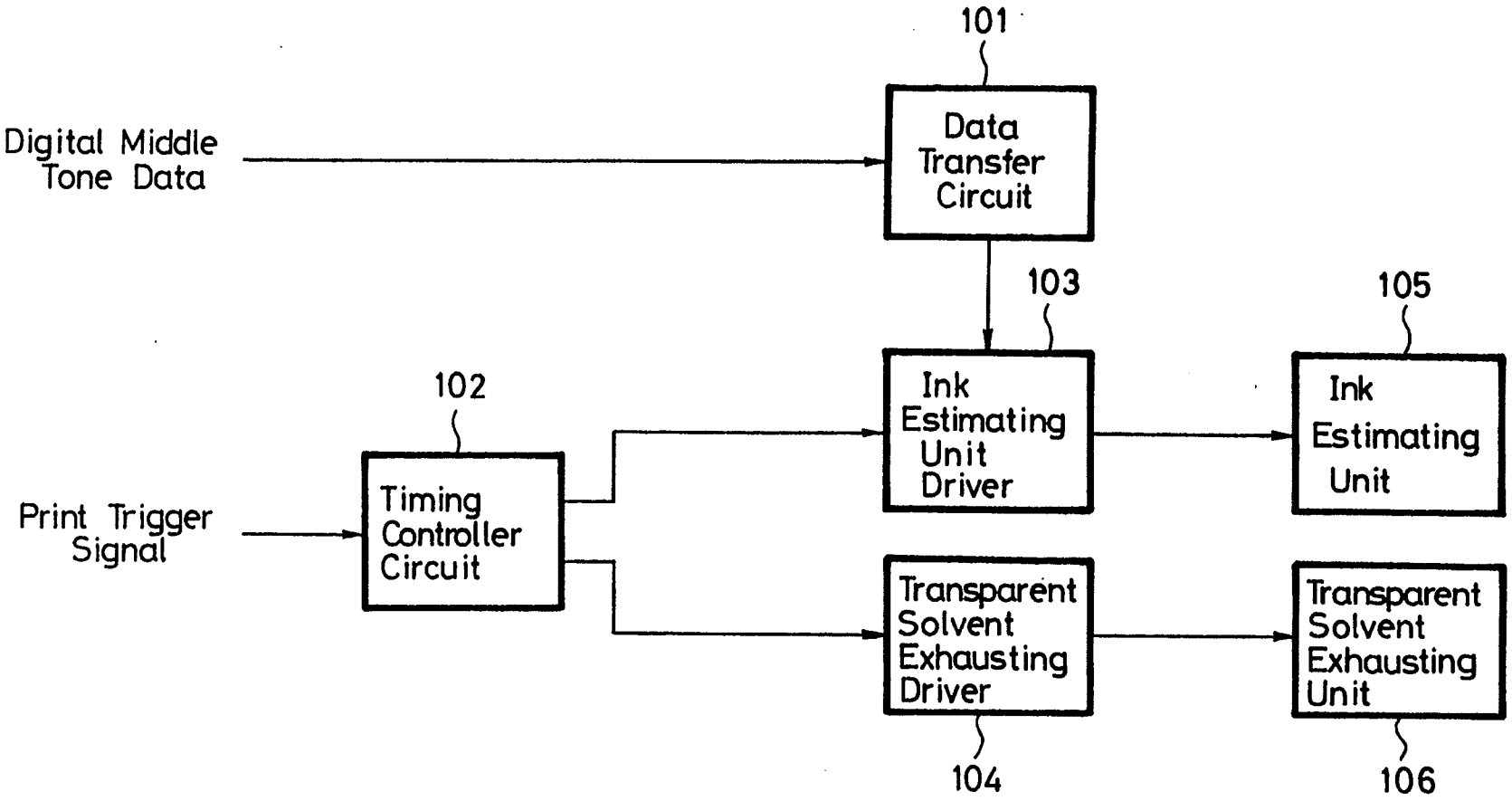
FIG. 41 is a block diagram showing a circuit configuration of an example of a driver circuit of the ink-jet print head according to the present invention.

FIG. 41 shows in block form an example of the circuit arrangement of the driver circuit that derives the voltage pulses shown in FIGS. 14.

As shown in FIG. 41, when digital middle tone data is supplied to the driver circuit from other block (not shown), the digital middle tone data is transferred to an ink estimating unit driver 103 through a data transfer circuit 101. Upon printing timing, a printing trigger signal is output from other block (not shown) and detected by a timing controller circuit 102. Then, the timing controller circuit 102 outputs an ink estimating unit enable signal and a transparent solvent exhausting enable signal to the ink estimating unit driver 103 and a transparent solvent exhausting driver 104 at predetermined timings, respectively. The above respective signals are output at the timings shown in FIG. 14, respectively.

The ink estimating unit driver 103 controls an ink estimating unit 105 on the basis of the ink estimating unit enable signal, whereby an ink of a predetermined amount is supplied to the ink orifice with a pressure owing to the electroosmosis process. On the other hand, the transparent solvent exhausting unit driver 104 controls the transparent solvent exhausting unit 106 on the basis of the transparent solvent exhausting enable signal which is delayed from the ink estimating unit enable signal by a predetermined delay time. Thus, the transparent solvent and the ink are exhausted while they are being mixed with each other.

As described above, according to the present invention, since the mixing unit is disposed near the nozzle communicated with the liquid chamber into which the transparent solvent is filled as the carrier liquid and the mixed liquid is exhausted by the ink-jet driving means, the nozzle can be prevented from being choked up and the maintenance thereof becomes easy. Also, since there is provided the adjusting means for adjusting the mixing amount of the ink, the middle tone printing of high quality becomes possible.

Further, since there are provided a plurality of adjusting means, the simultaneous printing in full color becomes possible. Also, since there are provided a plurality of nozzles which communicate with the liquid chamber, the line head can be constructed by the multi-nozzle system, thereby making it possible to carry out the high speed printing with ease.

Furthermore, since the one-way valve and the porous membranes are disposed in front of and behind the ink supplying path and the liquid chamber, the ink and the transparent solvent can be prevented from being mixed with each other naturally. Also, the estimation of the ink supplying amount can be controlled with high accuracy and hence, the continuous gradation recording of high definition becomes possible.

Moreover, since the opening and closing mechanism is disposed at the ink supplying orifice to the mixing unit, the ink and the transparent solvent can be prevented from being naturally mixed with each other more reliably. In addition, the density of ink can be controlled with high accuracy.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. An ink-jet print head comprising:

a liquid chamber into which a carrier liquid is filled;

ink-jet driving means disposed within said liquid chamber;

a nozzle communicated with said liquid chamber;

a mixing unit disposed in the vicinity of said nozzle for mixing an ink to said carrier liquid;

adjusting means for adjusting an amount of said ink mixed into said carrier liquid in said mixing unit, said adjusting means comprising an electroosmosis ink constant amount unit having a porous membrane disposed within an ink tank which is filled with said ink; and a first one-way valve that prevents a back current of said ink disposed in an ink supply path which communicates said ink tank and said mixing unit.

2. The ink-jet print head according to claim 1, wherein said adjusting means comprises a plurality of adjusting units which respectively adjust mixing amounts of inks of a plurality of colors.

3. The ink-jet print head according to claims 1, wherein said nozzle communicated with said liquid chamber is plural in number.

4. The ink-jet print head according to claim 1, further comprising a second porous membrane disposed on a connection portion between said ink supplying path and said mixing unit.

5. The ink-jet print head according to claim 1, further comprising a second one-way valve provided between said liquid chamber and said mixing unit.

6. The ink-jet print head according to claim 1, further comprising a third one-way valve disposed at the entrance of said liquid chamber.

7. The ink-jet print head according to claim 1, wherein said driving means disposed in said liquid chamber is a bimorph piezoelectric element.

8. The ink-jet print head according to claim 1, wherein said bimorph piezoelectric element is in contact with the carrier liquid within said liquid chamber.

9. The ink-jet print head according to claim 1, wherein said driving means disposed in said liquid chamber is a monomorph piezoelectric element.

10. The ink-jet printer according to claim 1, further comprising an opening and closing mechanism for adjusting a mixing amount of said ink disposed at an ink supplying orifice of said mixing unit.

11. The ink-jet print head according to claim 10, wherein said opening and closing mechanism comprises a valve seat and a piezoelectric element in which a spacing between it and said valve seat is changed by the application of a voltage to said piezoelectric element.

12. The ink-jet print head according to claim 10, wherein said opening and closing mechanism is a part of said driving means disposed in said liquid chamber and which is composed of said piezoelectric element.

13. The ink-jet print head according to claim 10, wherein a spacing between said valve seat and said piezoelectric element is opened and closed in a vibration fashion.

14. The ink-jet print head according to claim 10, wherein a spacing between said valve seat and said piezoelectric element is opened and closed by said ink-jet driving means.

15. The ink-jet print head according to claim 10, further comprising a plurality of mixing units, each having said opening and closing mechanism.

16. The ink-jet print head according to claim 15, wherein inks of different colors are mixed in a time division manner by said plurality of mixing units.

17. The ink-jet print head according to claim 10, wherein said plurality of mixing units mix inks of a plurality of colors by the changes of resonance frequencies of said piezoelectric elements provided in said plurality of mixing units, respectively.

18. The ink-jet print head according to claim 1, further comprising a rotary drum around which a material to be printed is wrapped, said print head being movable in the axial direction of said rotary drum; and driving means for moving said print head in the axial direction of said rotary drum in a ganged relation with a rotation of said rotary drum.

19. The ink-jet print head according to claim 18, further comprising a driving member for rotating said rotary drum in a ganged relation to the movement of said print head.

20. The ink-jet print head according to claim 18, wherein said print head includes a plurality of said ink-jet heads arrayed in the axial direction of said rotary drum.

21. The ink-jet print head according to claim 1, further comprising a plate having at least one hole of a diameter in a range of from 0.5 $\mu$m to 2 $\mu$m disposed on a connection portion between said ink supplying path and said mixing unit.

22. An ink-jet print head comprising:

a liquid chamber into which a carrier liquid is filled;

ink-jet driving means disposed within said liquid chamber, said driving means comprising a monomorph piezoelectric element;

a nozzle communicated with said liquid chamber;

a mixing unit disposed in the vicinity of said nozzle for mixing an ink to said carrier liquid;

adjusting means for adjusting an amount with which said ink is mixed into said carrier liquid in said mixing unit, said adjusting means comprising an electroosmosis ink constant amount unit having a first porous membrane disposed within an ink tank which is filled with said ink;

a first one-way valve that presents a back current of said ink disposed in an ink supply path which communicates said ink tank and said mixing unit;

a second one-way valve provided between said liquid chamber and said mixing unit;

a third one-way valve disposed at the entrance of said liquid chamber; and a plate having at least one small diameter hole disposed on a connection portion between said ink supplying path and said mixing unit.

23. An ink-jet printer comprising:

a rotary drum around which a material to be printed is wrapped;

a print head disposed movable in the axial direction said rotary drum; and driving means for moving said print head in the axial direction of said rotary drum in a ganged relation with a rotation of said rotary drum, said print head being an ink-jet print head comprising:

a liquid chamber into which a carrier liquid is filled;

ink-jet driving means disposed within said liquid chamber, said driving means comprising a monomorph piezoelectric element;

a nozzle communicated with said liquid chamber;

a mixing unit disposed in the vicinity of said nozzle for mixing an ink to said carrier liquid;

adjusting means for adjusting an amount with which said ink is mixed into said carrier liquid in said mixing unit, said adjusting means comprising an electroosmosis ink constant amount unit having a first porous membrane disposed within an ink tank which is filled with said ink;

a first one-way valve that presents a back current of said ink disposed in an ink supply path which communicates said ink tank and said mixing unit;

a second one-way valve provided between said liquid chamber and said mixing unit;

a third one-way valve disposed at the entrance of said liquid chamber; and a plate having at least one small diameter hole disposed on a connection portion between said ink supplying path and said mixing unit.

* * * * *